US010553926B2

(12) United States Patent
Xiang et al.

(10) Patent No.: US 10,553,926 B2
(45) Date of Patent: Feb. 4, 2020

(54) COAXIAL RESONANT CAVITY AND SYSTEM AND METHOD FOR MEASURING DIELECTRIC CONSTANT OF MATERIAL

(71) Applicant: University of Electronic Science and Technology of China, Chengdu, Sichuan (CN)

(72) Inventors: Yong Xiang, Sichuan (CN); Cong Wang, Sichuan (CN); Xuesong Feng, Sichuan (CN); Fenfen Liu, Sichuan (CN)

(73) Assignee: University of Electronic Science and Technology of China, Chengdu (CN)

( * ) Notice: Subject to any disclaimer, the term of this patent is extended or adjusted under 35 U.S.C. 154(b) by 112 days.

(21) Appl. No.: 15/739,169

(22) PCT Filed: Jul. 19, 2017

(86) PCT No.: PCT/CN2017/093494
§ 371 (c)(1),
(2) Date: Dec. 22, 2017

(87) PCT Pub. No.: WO2018/014842
PCT Pub. Date: Jan. 25, 2018

(65) Prior Publication Data

US 2019/0148810 A1 May 16, 2019

(30) Foreign Application Priority Data

Jul. 19, 2016 (CN) ..... 2016 1 0573558

(51) Int. Cl.
*H01P 7/04* (2006.01)
*H01P 7/10* (2006.01)
*H01P 7/06* (2006.01)

(52) U.S. Cl.
CPC ..... *H01P 7/04* (2013.01); *H01P 7/06* (2013.01); *H01P 7/10* (2013.01)

(58) Field of Classification Search
CPC ..... H01P 7/04; H01P 7/06; H01P 7/10
See application file for complete search history.

(56) References Cited

U.S. PATENT DOCUMENTS 4,451,806 A * 5/1984 Doner ..... H01P 7/04 333/207
5,689,523 A * 11/1997 Seguin ..... H01S 3/0315 372/18

(Continued)

*Primary Examiner* — Dominic E Hawkins
(74) *Attorney, Agent, or Firm* — Minder Law Group; Willy H. Wong

(57) ABSTRACT

The present disclosure is related to the microwave measuring field, and in particularly to a coaxial resonant cavity and system and method for measuring the dielectric constant of material. The coaxial resonant cavity includes a coupling mechanism and a cavity body. The coupling mechanism is accommodated in the cavity body for exciting or coupling microwaves inside the cavity body. The coaxial resonant cavity further includes a probe extending out of the cavity body and being coaxial with the cavity body. The cavity body is shaped as an annular column, and a ratio of an outer radius of the annular column to an inner radius of the annular column is (3-5):1. The present disclosure still provides a system and method for measuring the dielectric constant of material using the coaxial resonant cavity.

16 Claims, 19 Drawing Sheets

(56) References Cited

U.S. PATENT DOCUMENTS

| | | | | |
|---|---|---|---|---|
| 5,714,920 | A * | 2/1998 | Ivanov | H01P 7/10 333/219.1 |
| 5,900,390 | A * | 5/1999 | Das | H01P 1/202 333/207 |
| 6,173,604 | B1 * | 1/2001 | Xiang | G01Q 60/22 73/105 |
| 6,205,769 | B1 * | 3/2001 | Brandenburg | F03H 1/0093 60/203.1 |
| 6,597,185 | B1 * | 7/2003 | Talanov | B82Y 20/00 324/638 |
| 6,614,227 | B2 * | 9/2003 | Ookubo | B82Y 35/00 250/206 |
| 6,809,533 | B1 * | 10/2004 | Anlage | G01R 27/2664 324/750.02 |
| 6,946,835 | B1 * | 9/2005 | Xiang | G01N 24/00 324/300 |
| 7,285,963 | B2 * | 10/2007 | Talanov | B82Y 20/00 324/601 |
| 7,704,923 | B2 * | 4/2010 | Xiang | G01N 24/087 506/7 |
| 2002/0101307 | A1 * | 8/2002 | Liu | H01P 7/06 333/230 |
| 2007/0289532 | A1 * | 12/2007 | Hartsuiker | C03B 37/0183 118/723 I |
| 2009/0229581 | A1 * | 9/2009 | Ikeda | B01D 53/32 123/536 |
| 2015/0097639 | A1 * | 4/2015 | Liu | H01P 7/10 333/202 |

* cited by examiner (a)

(b)

(c)

(d)

(a)

(b)

(c)

(d)

(a)

(b)

(c)

(d)

(a)

(b)

(c)

(d)

COAXIAL RESONANT CAVITY AND SYSTEM AND METHOD FOR MEASURING DIELECTRIC CONSTANT OF MATERIAL

RELATED APPLICATIONS

This application is a national stage entry of International Application No. PCT/CN2017/093494, filed Jul. 19, 2017, and claims benefit of Chinese Patent Application No. CN201610573558.8, filed Jul. 19, 2016.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present disclosure relates to microwave measuring technologies, and particularly, to a coaxial resonant cavity, and a system and a method for measuring the dielectric constant of a material.

Related Art

The dielectric constant is an important electromagnetic parameter of a material. When a material is applied in the microwave technology, the dielectric constant is the main factor for evaluating the properties of the material, thus, it is important to measure the dielectric constant of the material.

At present, there are two types of methods for measuring the dielectric constant of a material, one is the network measuring method and the other is the resonant cavity method. The network measuring method includes a transmission line method and a free space method, etc. The network measuring method has a low sensitivity and thus is mainly used for measuring the microwave material having a high loss rate. The resonant cavity method has a high sensitivity, thus, the resonant cavity method can be used for measuring the microwave material having a high loss rate as well as the microwave material having a low loss rate.

However, due to time consuming operations and slow speed, the resonant cavity method takes too much time. Thus, the measurement of the dielectric constant through the resonant cavity method cannot meet corresponding measuring requirements.

SUMMARY OF THE INVENTION

Accordingly, one object of the present disclosure is to provide a coaxial resonant cavity, including a coupling mechanism and a cavity body. The coupling mechanism is accommodated in the cavity body for exciting or coupling microwaves inside the cavity body. The coaxial resonant cavity further includes a probe extending out of the cavity body and being coaxial with the cavity body. The cavity body is shaped as an annular column, and a ratio of an outer radius of the annular column to an inner radius of the annular column is (3-5):1.

Another object of the present disclosure is to provide a system for measuring the dielectric constant of material. The system includes a coaxial resonant cavity and a control system. The coaxial resonant cavity includes a cavity body and a probe extending out of the cavity body. The control system is configured for supplying an input microwave signal of the coaxial resonant cavity. The probe forms an electromagnetic field outside the cavity body, and a sample varies an output microwave signal of the coaxial resonant cavity through interfering with the electromagnetic field. The control system is further configured for calculating the dielectric constant of the sample by analyzing the output microwave signals of the coaxial resonant cavity before and after the placement of the sample.

A further object of the present disclosure is to provide a measuring method based on the system for measuring the dielectric constant of material. The method includes the following steps: obtaining a resonant frequency and a quality factor when a coaxial resonant cavity is in a hollow state; placing a sample; performing a frequency sweep to obtain the resonant frequency and the quality factor of the coaxial resonant cavity after the placement of the sample; and calculating the dielectric constant of the sample according to the resonant frequencies and the quality factors of the coaxial resonant cavity before and after the placement of the sample.

Other objects, advantages and novel features of the disclosure will become more apparent from the following detail description when taken in conjunction with the accompanying drawings.

BRIEF DESCRIPTION OF THE DRAWINGS

The present disclosure will be described in more detail with reference to the accompany drawings and the embodiments, wherein in the drawings.

DETAILED DESCRIPTION OF THE INVENTION

In order to illustrate the objects, technical solutions and advantages of the present invention more clearly, detailed description is made to the present invention with reference to the accompanying drawings and embodiments. It should be understood that the specific embodiments described herein are only intended to illustrate rather than limit the present invention.

A coaxial resonant cavity 10 in accordance with an embodiment of the present disclosure is provided.

Figure 1:
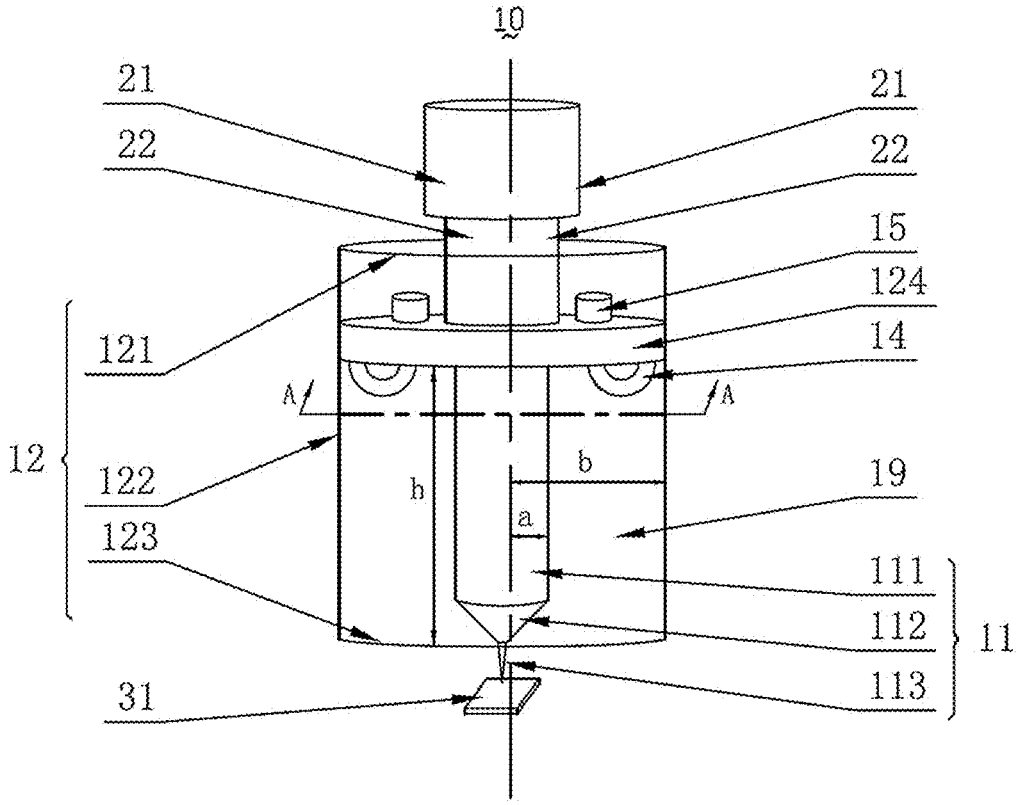
FIG. 1 is a schematic view of a coaxial resonant cavity of a system for measuring the dielectric constant of a material in accordance with an embodiment of the present disclosure.
Figure 2:
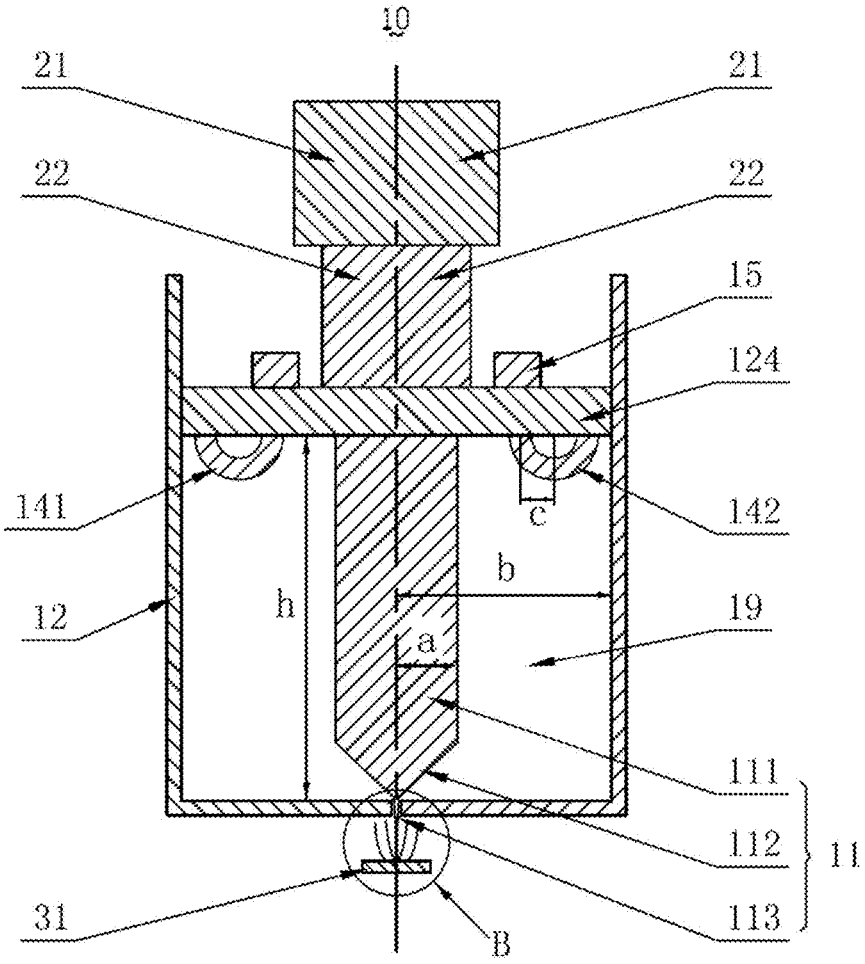
FIG. 2 is a cross-sectional view of FIG. 1 taken along A-A.
Figure 3:
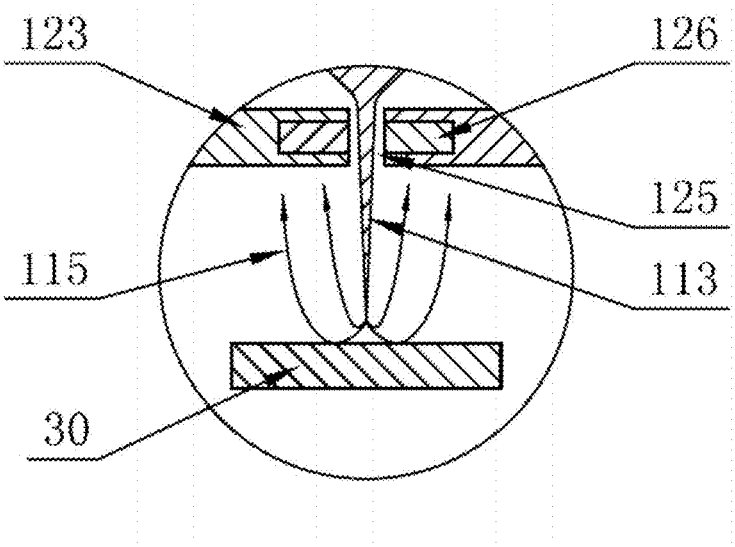
FIG. 3 is an enlarged view of a portion B of FIG. 1.

Referring to FIG. 1 and FIG. 2, the coaxial resonant cavity 10 includes a coupling mechanism 14 and a cavity body 19. The coupling mechanism 14 is configured for exciting and coupling microwaves inside the cavity body 19, that is, inputting microwaves into the cavity body 19 to form stimulus of the cavity body 19, coupling microwave signals inside the cavity body 19, and outputting the microwave signals. The coaxial resonant cavity 10 further includes a probe 113 extending out of the cavity body 19. The probe 113 is coaxial with the cavity body 19. Through the excitation from the coupling mechanism 14, an electromagnetic field is formed inside the cavity body 19; due to the arrangement of the probe 113, the electromagnetic field formed around a tip point of the probe 113 has a very concentrated strength, electric field lines of which are arranged as shown in FIG. 3.

The cavity body 19 is shaped as an annular column, and a ratio of an outer radius to an inner radius of the annular column is (3-5):1. When the ratio of the outer radius of the inner radius of the annular column is (3-5):1, there is a litter clutter around higher harmonics of the coaxial resonant cavity 10 such as a third harmonic and a fifth harmonic of the coaxial resonant cavity 10, and the higher harmonics have high quality factors. Since a resonant frequency of a higher harmonic is obviously higher than that of a fundamental harmonic, for example, resonant frequencies of the third and the fifth harmonics are respectively three times and five times as that of the fundamental harmonic, thus, the resonant frequency of the coaxial resonant cavity 10 can be greatly improved by controlling the ratio of the outer radius to the inner radius of the annular column to be (3-5):1 and does not on the basis of the need to reduce the size of the coaxial resonant cavity 10. In an embodiment, when the ratio of the outer radius to the inner radius of the annular column is 4:1, the coaxial resonant cavity 10 with a high resonant frequency as well as a high quality factor can be obtained.

A height of the cavity body 19 is adjustable, that is, a cavity length h of the coaxial resonant cavity 10 is adjustable. Through adjusting the height of the cavity body 19, that is, adjusting the cavity length h, the resonant frequency of the coaxial resonant cavity 10 can be varied. The smaller the cavity length h is, the higher the resonant frequency of the coaxial resonant cavity 10 is. Thus, the resonant frequency of the coaxial resonant cavity 10 varies as the height of the cavity body 19 is adjusted, and the resonant frequency range of the coaxial resonant cavity 10 corresponds to the variation range of the height of the cavity body 19. Since the ratio of the outer radius to the inner radius of the annular column is controlled to be (3-5):1, the coaxial resonant cavity 10 has a high resonant frequency and thus a wide resonant frequency range. The resonant frequency of the coaxial resonant cavity 10 can be continuously varied within the resonant frequency range by adjusting the height of the cavity body 19, thus, the resonant frequency of the coaxial resonant cavity 10 can be rapidly adjusted within the resonant frequency range by adjusting the height of the cavity body 19.

In an embodiment, as shown in FIG. 1 and FIG. 2, a slider 124 capable of moving along an axial direction of the cavity body 19 is arranged inside the cavity body 19. The cavity length h can be adjusted when the slider 124 moves along the axial direction through the simple configuration. In an embodiment, the coaxial resonant cavity 10 includes an adjusting assembly for moving the slider 124. The adjusting assembly includes a telescopic rod 22 connected to the slider 124 and an actuator 21 for controlling extension and retraction of the telescopic rod 22. The extension and retraction of the telescopic rod 22 drives the slider 124 to move along the axial direction, thereby varying the cavity length h. Therefore, the cavity length h can be rapidly and accurately adjusted through the configuration. However, an excessively small cavity length h may result in too much clutter in the outputted microwave signals, which may greatly interfere with the higher harmonics, thus, in an embodiment, the cavity length h of the coaxial resonant cavity 10 can be adjusted to be greater than the sum of the outer radius and the inner radius of the annular column of the cavity body 19.

In an embodiment, the coaxial resonant cavity 10 further includes an inner conductor 11 and an outer conductor 12. The inner conductor 11 includes a cylindrical main body 111. An end surface of the main body 111 which is away from the slider 124, that is, adjacent to a bottom of the cavity body 19 forms a tip point. The bottom of the cavity body 19 defines a hole 125 through which the tip point extends out of the cavity body 19 to form the probe 113. An outer wall of the inner conductor 11 forms an inner surface of the annular column of the cavity body. The outer conductor 12 is hollow, and an inner wall of the outer conductor 12 forms an outer surface of the annular column of the cavity body 19. That is, the cavity body 19 is formed between the outer wall of the inner conductor 11 and the inner wall of the outer conductor 12. Since the inner conductor 11 and the outer conductor 12 are independently and coaxially arranged, the inner conductor 11 and the outer conductor 12 can be easily replaced to adjust the outer radius and the inner radius of the annular column of the cavity body 19. Referring to FIG. 2, the radius of the main body 111 is the radius a of the inner conductor 11, and the radius a is the inner radius of the annular column of the cavity body. In an embodiment, a transition portion 112 is arranged between the main body 111 and the probe 113 for ensuring stable transmission of microwaves at the connection between the main body 111 and the probe 113. In some embodiments, the transition portion 112 is shaped as a truncated cone, one end surface of the truncated cone with a relatively larger area is connected to the end surface of the main body 111, and the probe 113 is configured on one end surface of the truncated cone with a relatively smaller area. Through the simple configuration, the transmission of microwaves is stable. The inner conductor 11 can be integrally formed or has a sparatable configuration, for example, the probe 113 may be detachable for easy replacement.

On the basis that the hollow portion of the outer conductor 12 is cylindrical and the cavity body 19 being shaped as the annular column can be formed between the inner wall of the outer conductor 12 and the outer wall of the inner conductor 11, the outer conductor 12 can be shaped as a cube, a square, a cuboid or a cylinder, which is not limited herein.

In an embodiment, as shown in FIG. 1, the outer conductor 12 is shaped as a hollow cylinder, one end of the conductor 12, that is, a top of the cavity body 19 forms an open end 121, and the other end of the outer conductor 12 is enclosed to form an enclosed end 123. Thus, the outer conductor 12 includes a cylindrical outer wall 122, the open end 121, and the enclosed end 123. The slider 124 is arranged in the outer conductor 12 and is movable along the axial direction of the outer conductor 12. A shape of the slider 124 is in conformity with the cylindrical outer wall 122 such that the slider 124 is capable of enclosing the open end 121. One end of the main body 111 of the inner conductor extends out of the slider 124 through a through hole (not shown) defined in the slider 124. A radius of the cylindrical outer wall 122 is the radius b of the outer conductor 12, and the radius b of the outer conductor 12 is the outer radius of the annular column of the cavity body 19.

Figure 4:
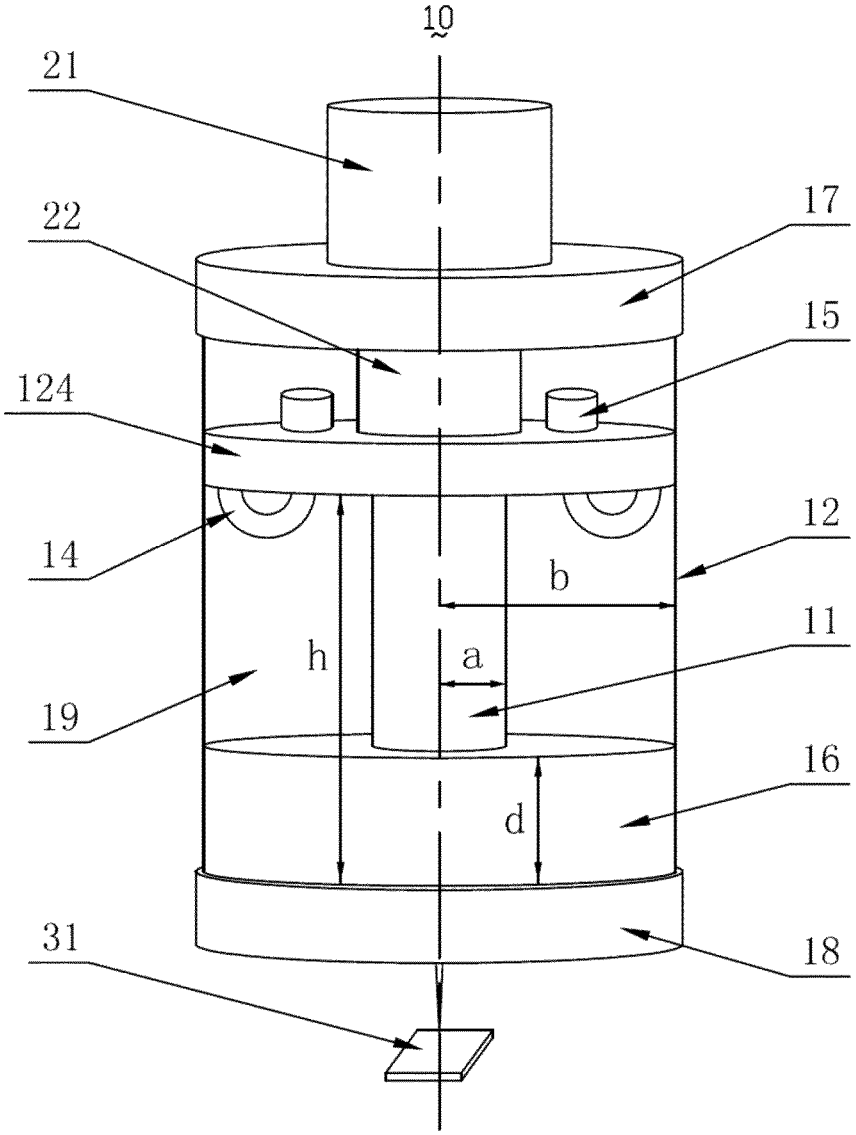
FIG. 4 is a schematic view of the coaxial resonant cavity in accordance with some embodiments of the present disclosure.
Figure 5A:
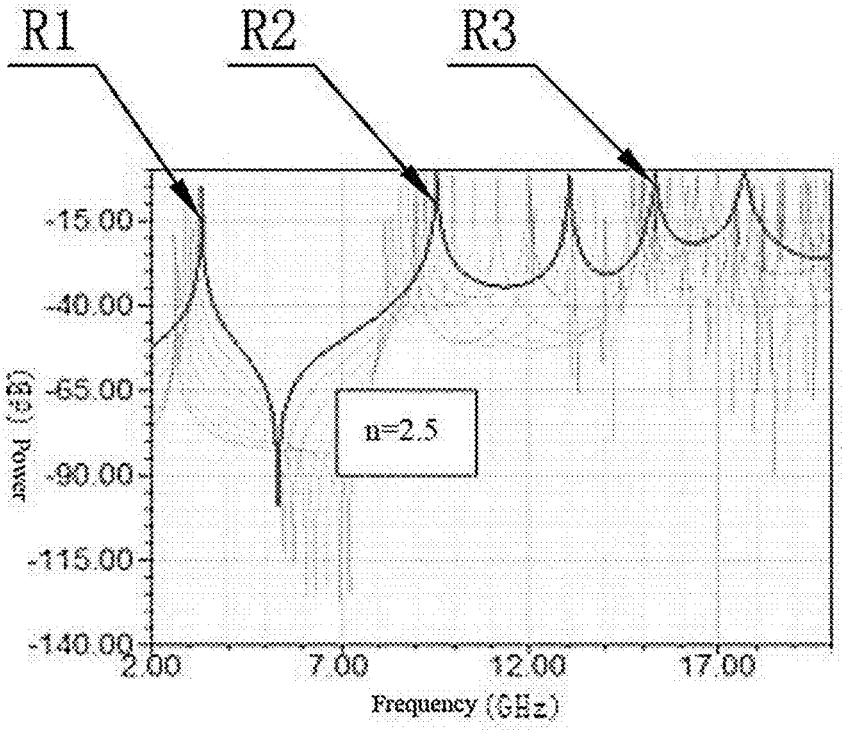
FIG. 5A is a schematic view showing the effect of ratios of a radius of an outer conductor to a radius of an inner conductor is 2.5 on harmonics of the coaxial resonant cavity in accordance with an embodiment of the present disclosure.
Figure 5B:
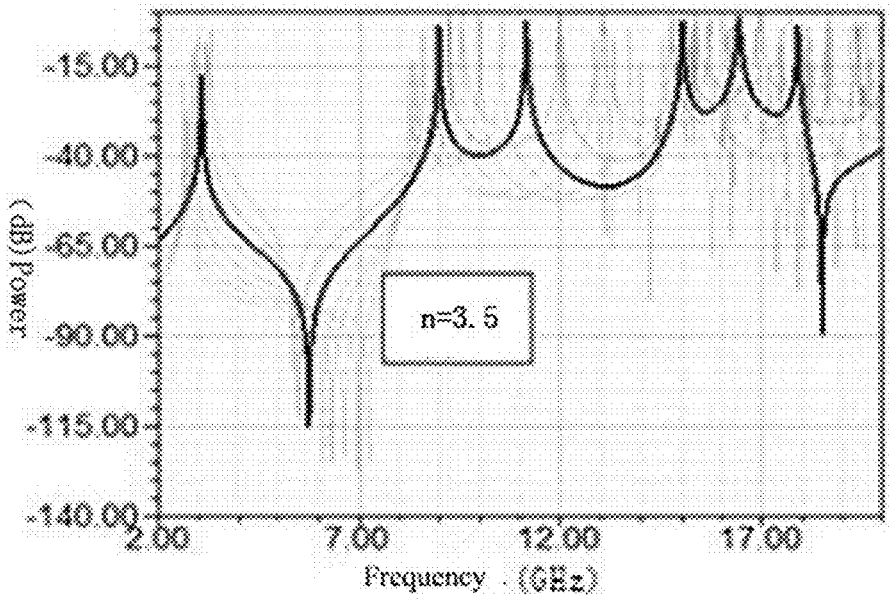
FIG. 5B is a schematic view showing the effect of ratios of a radius of an outer conductor to a radius of an inner conductor is 3.5 on harmonics of the coaxial resonant cavity in accordance with an embodiment of the present disclosure.
Figure 5C:
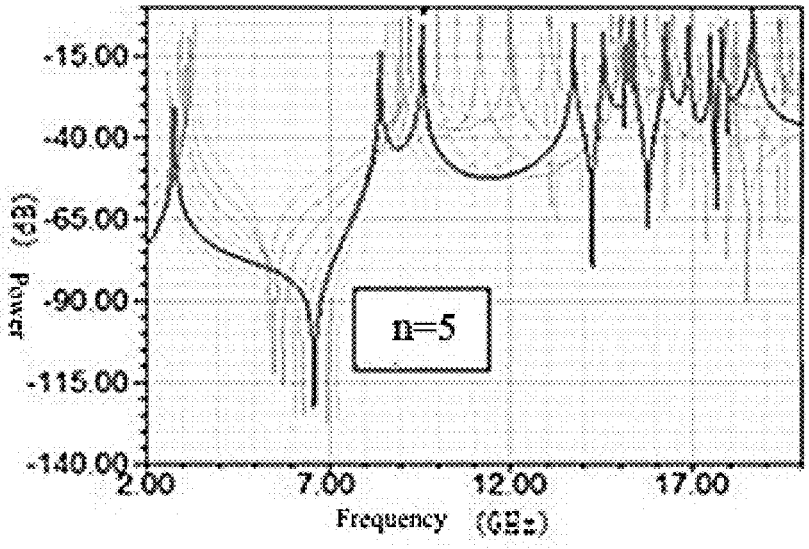
FIG. 5C is a schematic view showing the effect of ratios of a radius of an outer conductor to a radius of an inner conductor is 5 on harmonics of the coaxial resonant cavity in accordance with an embodiment of the present disclosure.
Figure 5D:
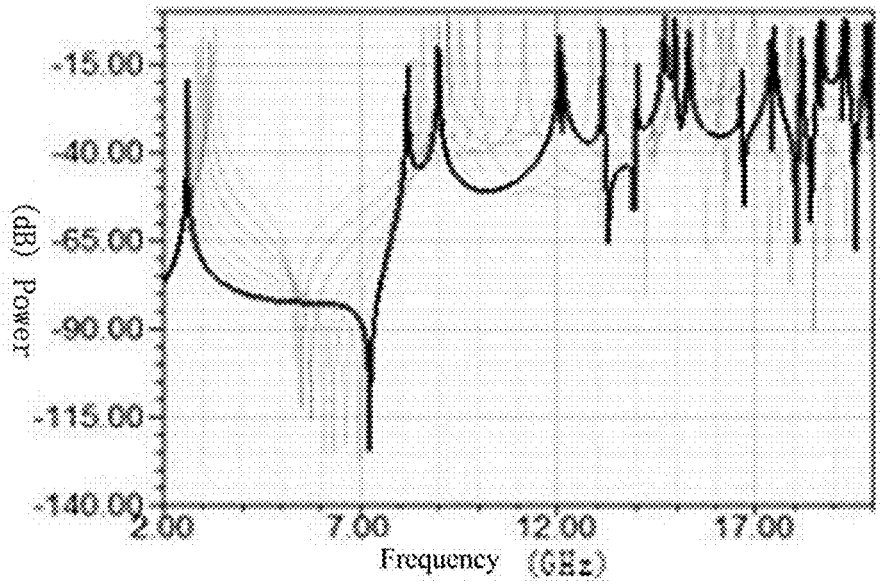
FIG. 5D is a schematic view showing the effect of ratios of a radius of an outer conductor to a radius of an inner conductor is 6 on harmonics of the coaxial resonant cavity in accordance with an embodiment of the present disclosure.

Referring to FIG. 4, in an embodiment, the open end 121 of the outer conductor 12 is configured with a first end cover 17. The actuator 21 is fixed on the first end cover 17 for improving the stability of the whole coaxial resonant cavity 10. In an embodiment, as shown in FIG. 3, an isolating ring 126 is arranged at the hole 125 defined in the enclosed end 123 and surrounds the probe 113. The isolating ring 126 is made of aluminum oxide and has a good isolating effect.

According to the present disclosure, the microwaves, which are excited by the coupling mechanism 14, transmit as simple transverse electric and magnetic field (TEM) waves inside the cavity body 19 of the coaxial resonant cavity 10. The coupling mechanism 14 can be a coupling probe, a coupling ring, or a coupling hole. The coupling method of the coupling probe is electric coupling, the coupling method of the coupling ring is magnetic coupling, and the coupling method of the coupling hole is diffraction coupling. According to the position of the coupling hole, the coupling method can be electric coupling or magnetic coupling, or one involving both electric coupling and magnetic coupling.

In an embodiment, the coupling mechanism 14 is a coupling ring and the coupling method is magnetic coupling. The analysis of the transmission of the microwaves inside the coaxial resonant cavity 10 is relatively simple. The magnetic field at the end of the cavity body 19 adjacent to the slider 124 is the strongest, while the electric field is the weakest; after the microwaves transmit as TEM waves inside the cavity body 19 over a quarter of a period, the magnetic field at the end becomes the weakest while the electric field becomes the strongest. Thus, the cavity length h of the cavity body 19 can be set, by moving the slider 124, that is, by varying the cavity length h, to be one quarter of a wavelength of the microwaves inside the cavity body 19. In this way, the microwaves reach the enclosed end 123 of the outer conductor 12 over a quarter of a period, and the electric field at the enclosed end 123 becomes the strongest and forms a strong electric field outside the cavity body 19 by extending out of the cavity body 19 through the probe 113. The electric strength of the strong electric field outside the cavity body 19 may reach 10 kV/cm.

In some embodiments, the coupling ring is arranged on one side of the slider 124 facing the cavity body 19. A connection member 15 is arranged on one side of the slider 124 facing the coupling ring for being connected to a microwave signal generator (not shown) or a microwave signal receiver (not shown). That is, the microwave signal generator inputs a first microwave signal to the coupling ring through the connection member 15. The first microwave signal is converted to a second microwave signal transmitting inside the cavity body 19 through the coupling effect from the coupling ring. The second microwave signal is finally coupled to form a third microwave signal outputted to a microwave signal receiver by the coupling ring. A single coupling ring can realize the conversion of the first microwave signal to the second microwave signal and the transmissions of the first and second microwave signals, and realize the conversion of the second microwave signal to the third microwave signal and the transmissions of the second and third microwave signals, thus, the coupling mechanism can include one or more coupling rings.

In other embodiments, the coupling ring includes a first coupling ring 141 and a second coupling ring 142 symmetric to the first coupling ring 141 about an axis of the coaxial resonant cavity 10. The first coupling ring 141 and the second coupling ring 142 are respectively configured for inputting and outputting the microwave signal. That is, the microwave signal is inputted to the coaxial resonant cavity 10 through the first coupling ring 141 and a resonant microwave signal generated by the coaxial resonant cavity 10 are outputted from the coaxial resonant cavity 10 through the second coupling ring 142. Thus, the stimulus and coupling effect inside the coaxial resonant cavity 10 can be effectively improved. As shown in FIG. 2, a radius of the coupling ring is c; in an embodiment, in order to avoid clutter in the microwave signals and ensure a relatively high quality factor, the ratio of the radius of the coupling ring to the inner radius of the annular column of the cavity body 19, that is, the ratio of the radius of the coupling ring to the radius of the inner conductor 11 is (0.5-1):1, that is, c/a=(0.5-1):1. In an embodiment, the ratio of the radius of the coupling ring to the radius of the inner conductor is 0.5, that is, c/a=0.5.

In an embodiment, as shown in FIG. 4, a dielectric layer 16 is arranged on one end of the cavity body 19 adjacent to the probe 113. A shape of the dielectric layer 16 is in conformity with the cavity body 19. The dielectric layer 16 is made of inorganic material with the dielectric constant being greater than 1. The arrangement of the dielectric layer 16 is capable of reducing the resonant frequency of the coaxial resonant cavity 10 and thus widens the resonant frequency range of the coaxial resonant cavity 10.

The principle that the arrangement of the dielectric layer 16 is capable of reducing the resonant frequency of the coaxial resonant cavity 10 is explained as follows.

The wavelength of the microwaves transmitting in the coaxial resonant cavity 10 can be expressed by a wave velocity and the resonant frequency as follows:

$$\lambda=v/f \tag{1}$$

wherein λ is the wavelength, v is the wave velocity, and f is the resonant frequency.

During the transmission of the microwaves, a following formula can be obtained by keeping the wavelength of the dielectric layer 16 unvaried:

$$v_1/f_1=v_2/f_2 \tag{2}$$

wherein $v_1$ and $v_2$ are wave velocities of the microwaves before and after the microwaves transmit through the dielectric layer 16 respectively. Before the microwaves transmit through the dielectric layer 16, the microwaves transmit in air and thus v1 can be expressed by a light velocity c; thus, the wave velocity of the microwaves when the microwaves transmit in the dielectric layer 16 can be expressed as:

$$v_2=c/n \tag{3}$$

wherein n is a refractivity. Since the dielectric layer 16 is made of inorganic material, the refractivity can be expressed as:

$$n=\sqrt{\mu\varepsilon_1} \tag{4}$$

wherein μ is a magnetic permeability of the dielectric layer 16, and $\varepsilon_1$ is the dielectric constant of the dielectric layer 16. Since the dielectric layer 16 is made of inorganic material, the magnetic permeability thereof is approximately equal to 1, thus μ=1.

Thus, the following formula can be obtained:

$$f_2/f_1=\sqrt{\varepsilon_1} \tag{5}$$

Since the dielectric constant of the dielectric layer 16 is greater than 1, that is, $\varepsilon_1$ is greater than 1, thus, $f_2/f_1$ is less than 1, that is, $f_2$ is less than $f_1$. Thus, the resonant frequency is reduced.

Figure 6:
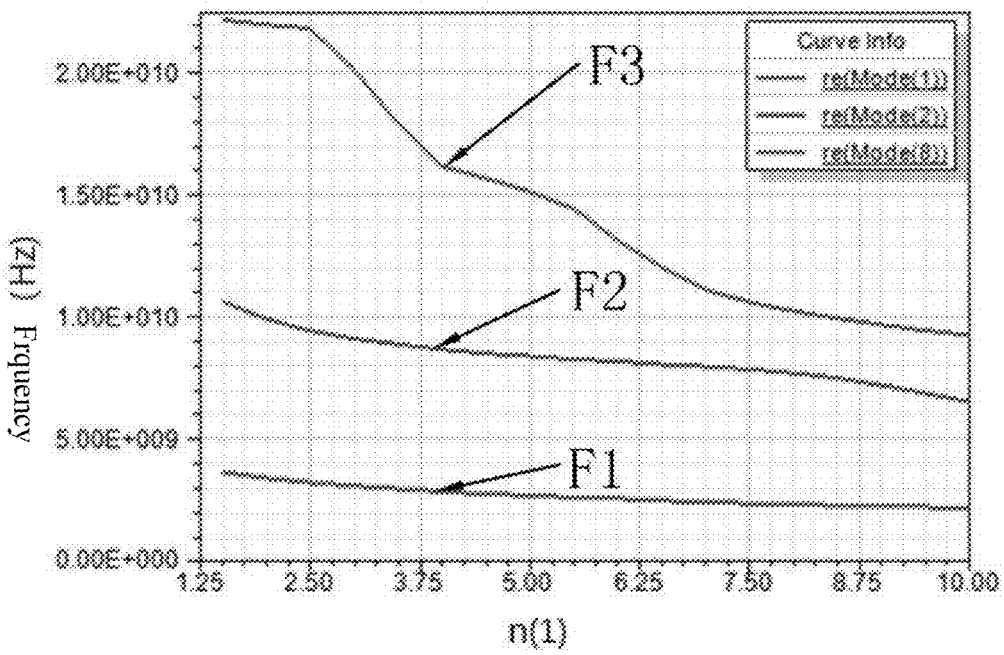
FIG. 6 is a schematic view showing variation of resonant frequencies of a fundamental harmonic, a third harmonic, a fifth harmonic of the coaxial resonant cavity as the ratio of the radius of the outer conductor to the radius of the inner conductor increases in accordance with an embodiment of the present disclosure.

In an embodiment, as shown in FIG. 4, the enclosed end 123 of the outer conductor 12 is a detachable second end cover 18, which facilitates the replacement of the dielectric layer 16 for obtaining different resonant frequency ranges. In an embodiment, the dielectric layer 16 is made of aluminum oxide; due to a small dielectric loss of aluminum oxide, high quality factors of the coaxial resonant cavity 10 can be ensured. As shown in FIG. 6, a thickness of the dielectric layer 16 is d.

In an embodiment, when the ratio of the thickness of the dielectric layer 16 to the inner radius of the annular column of the cavity body 19, that is, the ratio of the thickness of the dielectric layer 16 to the radius of the inner conductor 11 is (1.5-2.5):1, that is, d/a ranges from 1.5 to 2.5, the resonant frequency can be effectively reduced and a high quality factor can be ensured. In an embodiment, the ratio of the thickness of the dielectric layer 16 to the inner radius of the annular column of the cavity body 19 is equal to 2, that is, d/a=2.

The above parameters of the coaxial resonant cavity 10 can be verified through simulation tests including a microwave signal test, a resonant frequency test, and a quality factor test, etc.

The coaxial resonant cavity 10 is verified in the following method.

Firstly, the effect of the ratio of the radius of the outer conductor 12 to the radius of the inner conductor 11 on the harmonics of the coaxial resonant cavity 10

Figure 7:
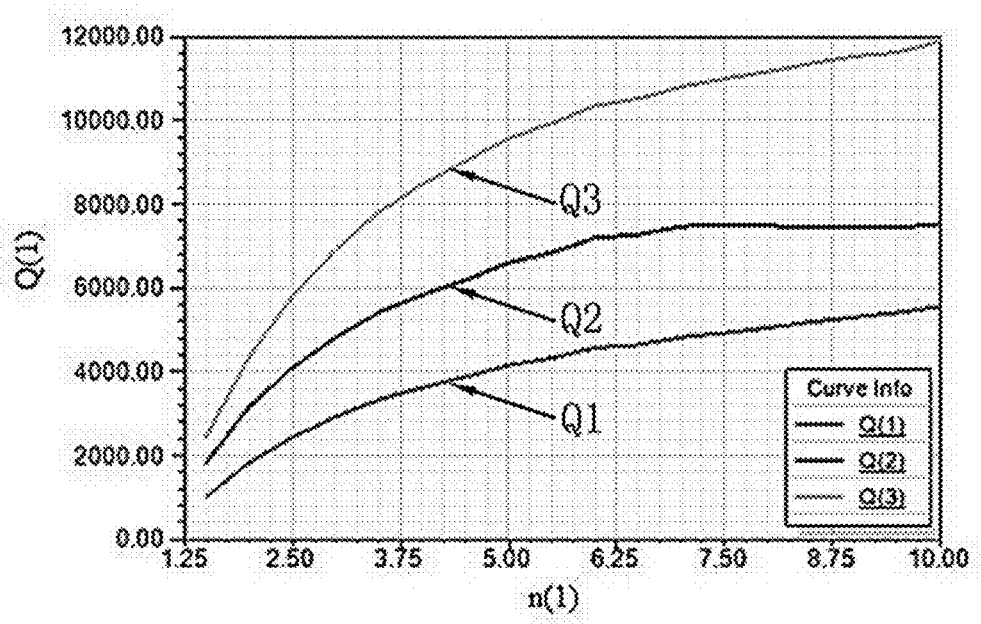
FIG. 7 is a schematic view showing variations of quality factors of the fundamental harmonic, the third harmonic, the fifth harmonic of the coaxial resonant cavity as the ratio of the radius of the outer conductor to the radius of the inner conductor increases in accordance with an embodiment of the present disclosure.
Figure 8A:
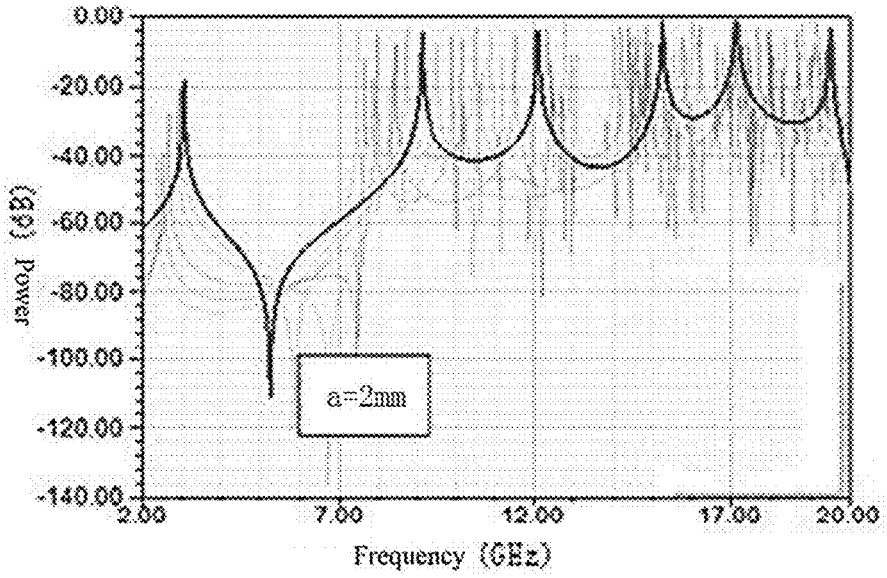
FIG. 8A is a schematic view showing the effect of inner conductor radiuses is 2 mm on the harmonics of the coaxial resonant cavity in accordance with an embodiment of the present disclosure.
Figure 8B:
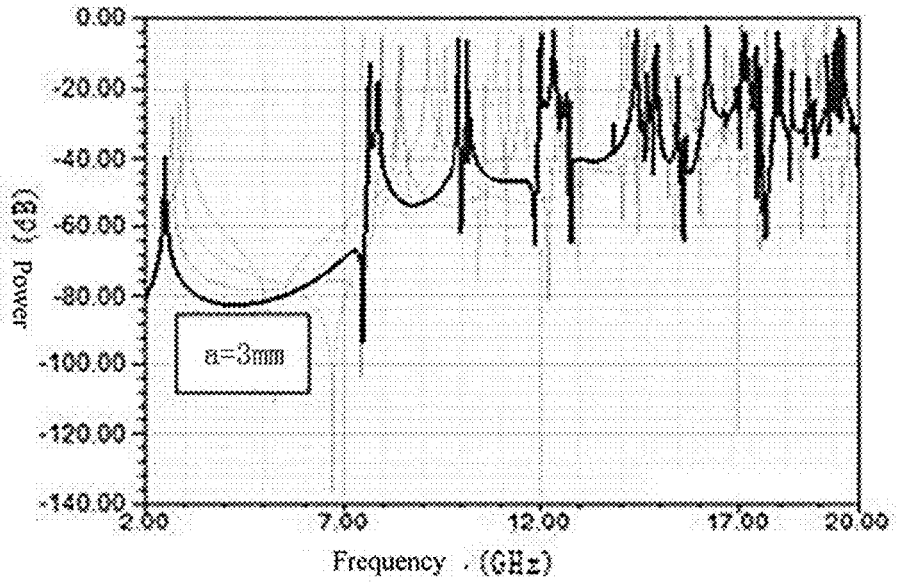
FIG. 8B is a schematic view showing the effect of inner conductor radiuses is 3 mm on the harmonics of the coaxial resonant cavity in accordance with an embodiment of the present disclosure.
Figure 8C:
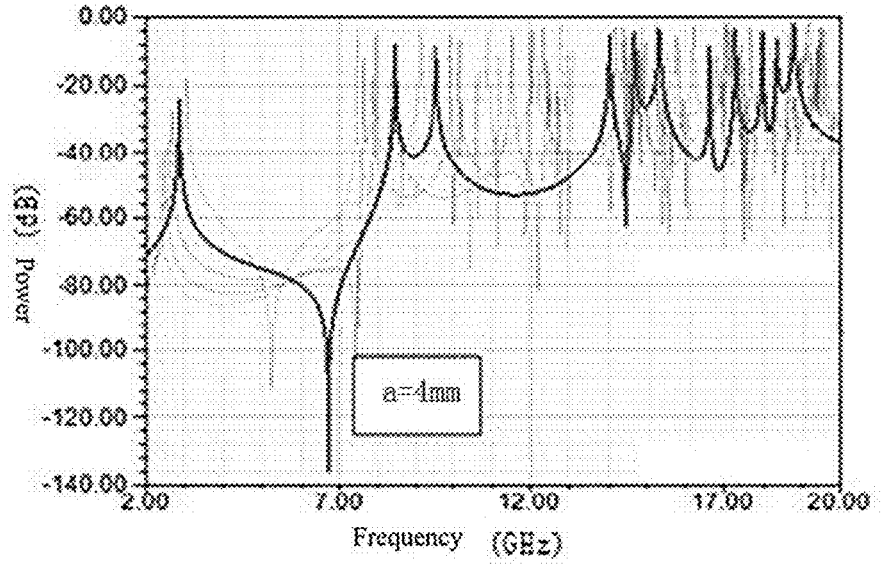
FIG. 8C is a schematic view showing the effect of inner conductor radiuses is 4 mm on the harmonics of the coaxial resonant cavity in accordance with an embodiment of the present disclosure.
Figure 8D:
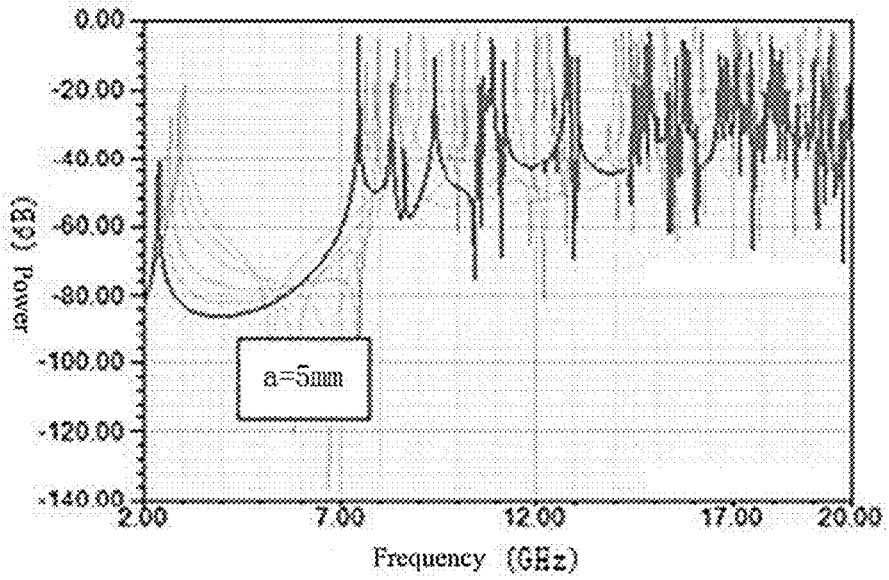
FIG. 8D is a schematic view showing the effect of inner conductor radiuses is 5 mm on the harmonics of the coaxial resonant cavity in accordance with an embodiment of the present disclosure.
Figure 9A:
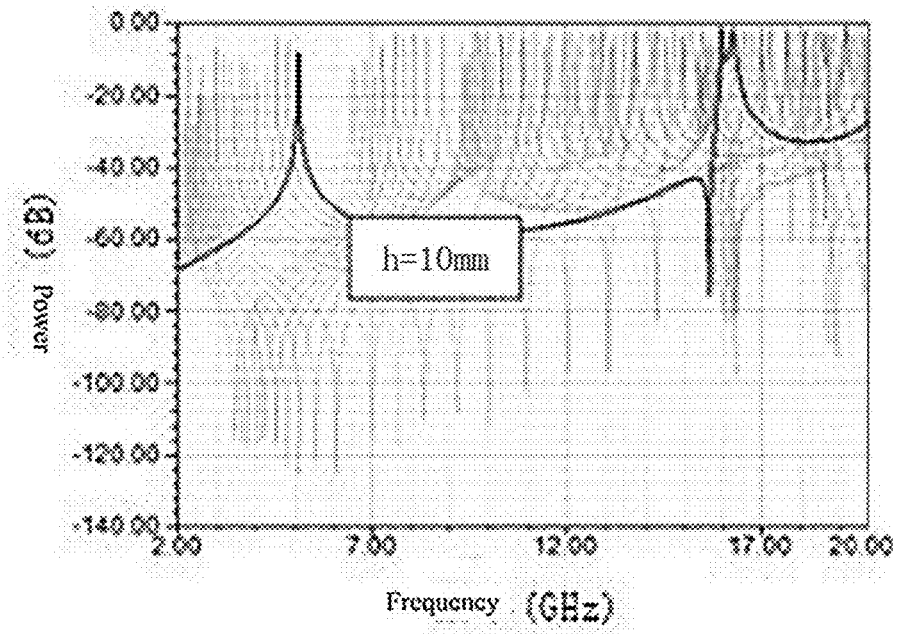
FIG. 9A is a schematic view showing the effect of cavity lengths is 10 mm on the harmonics of the coaxial resonant cavity in accordance with an embodiment of the present disclosure.
Figure 9B:
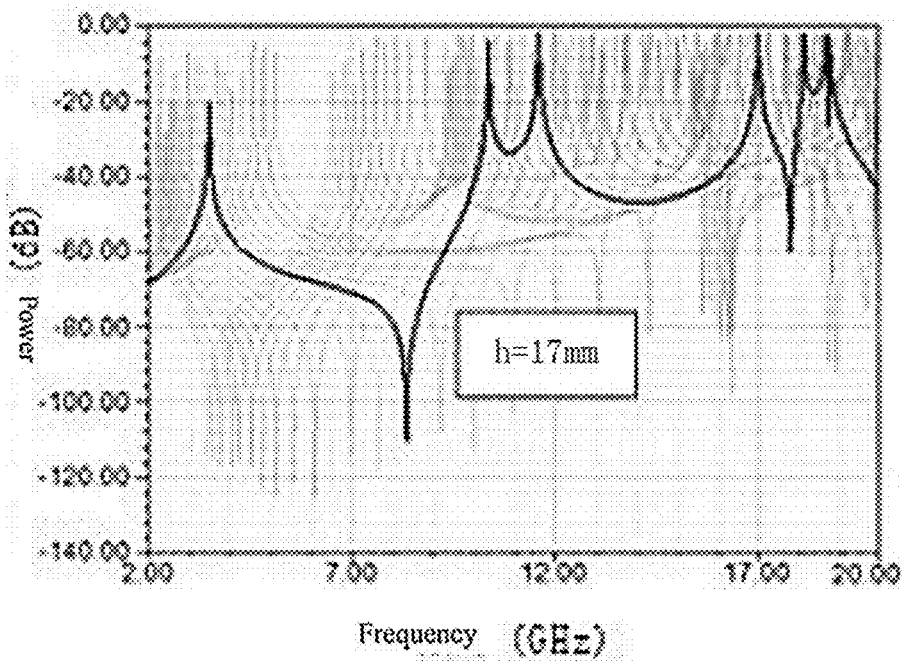
FIG. 9B is a schematic view showing the effect of cavity lengths is 17 mm on the harmonics of the coaxial resonant cavity in accordance with an embodiment of the present disclosure.
Figure 9C:
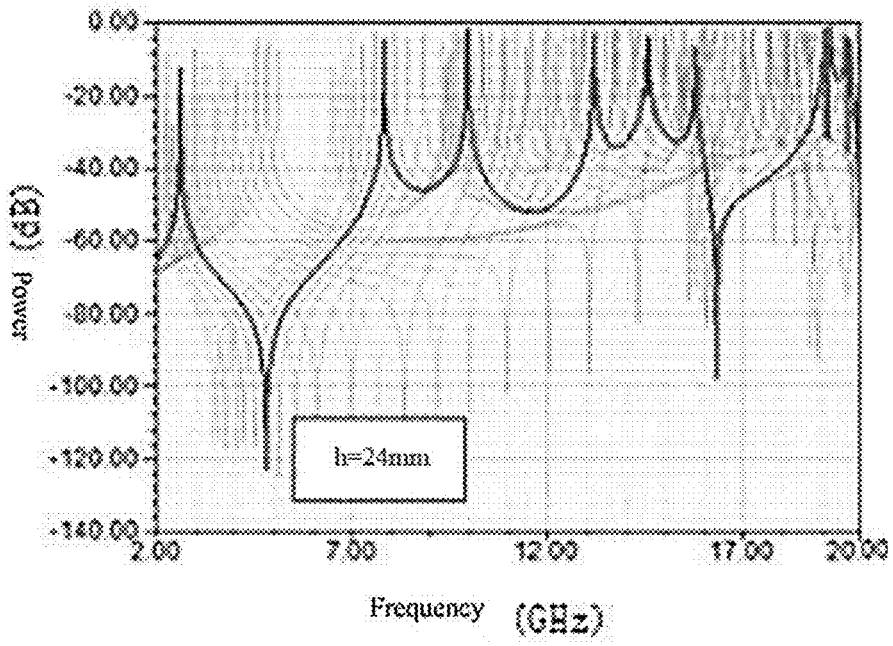
FIG. 9C is a schematic view showing the effect of cavity lengths is 24 mm on the harmonics of the coaxial resonant cavity in accordance with an embodiment of the present disclosure.
Figure 9D:
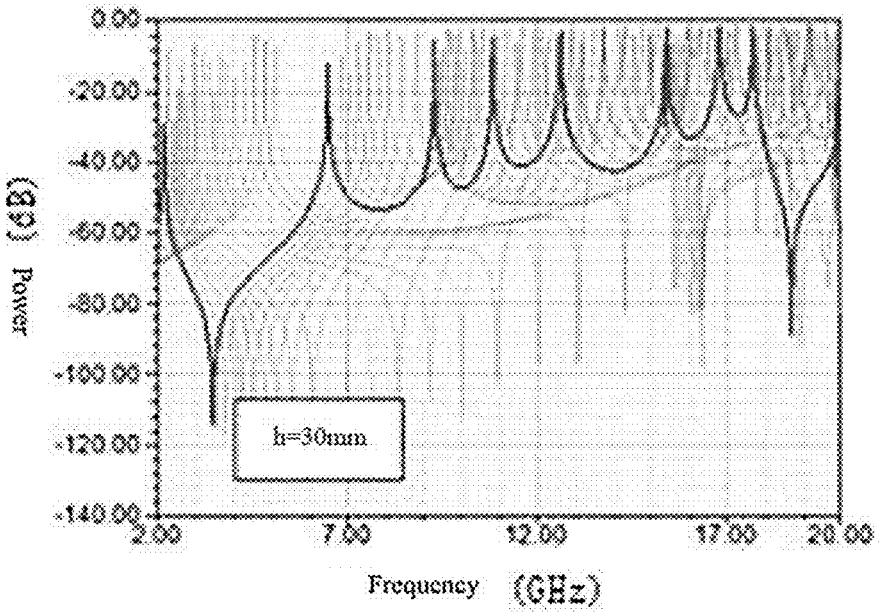
FIG. 9D is a schematic view showing the effect of cavity lengths is 30 mm on the harmonics of the coaxial resonant cavity in accordance with an embodiment of the present disclosure.
Figure 10A:
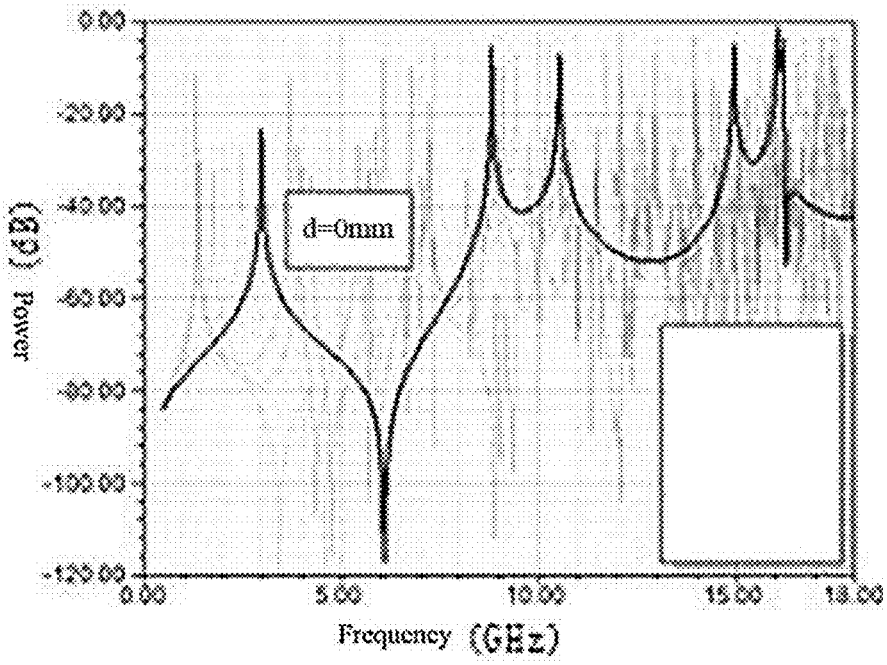
FIG. 10A is a schematic view showing the effect of thicknesses of a dielectric layer is 0 mm on the harmonics of the coaxial resonant cavity in accordance with an embodiment of the present disclosure.
Figure 10B:
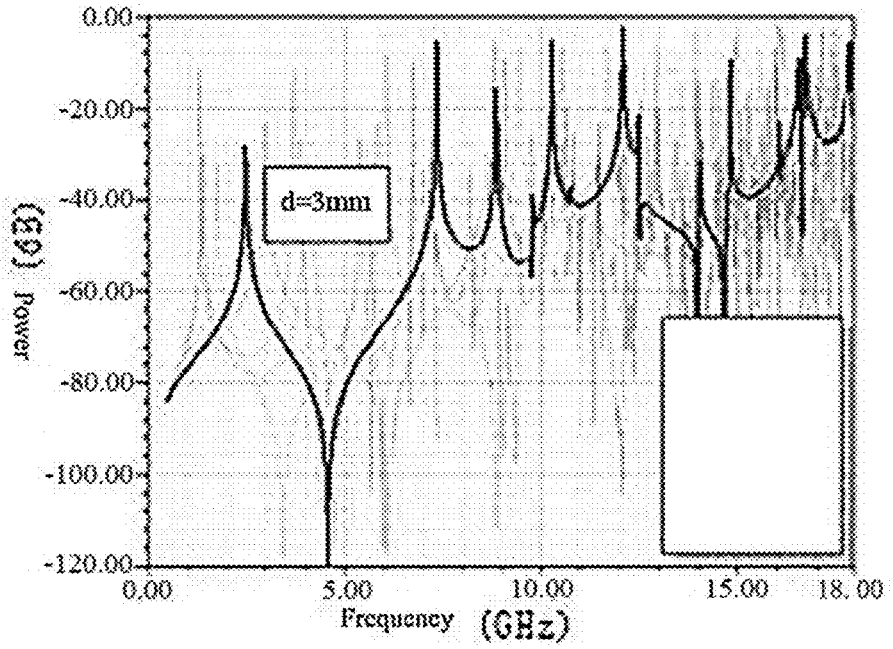
FIG. 10B is a schematic view showing the effect of thicknesses of a dielectric layer is 3 mm on the harmonics of the coaxial resonant cavity in accordance with an embodiment of the present disclosure.
Figure 10C:
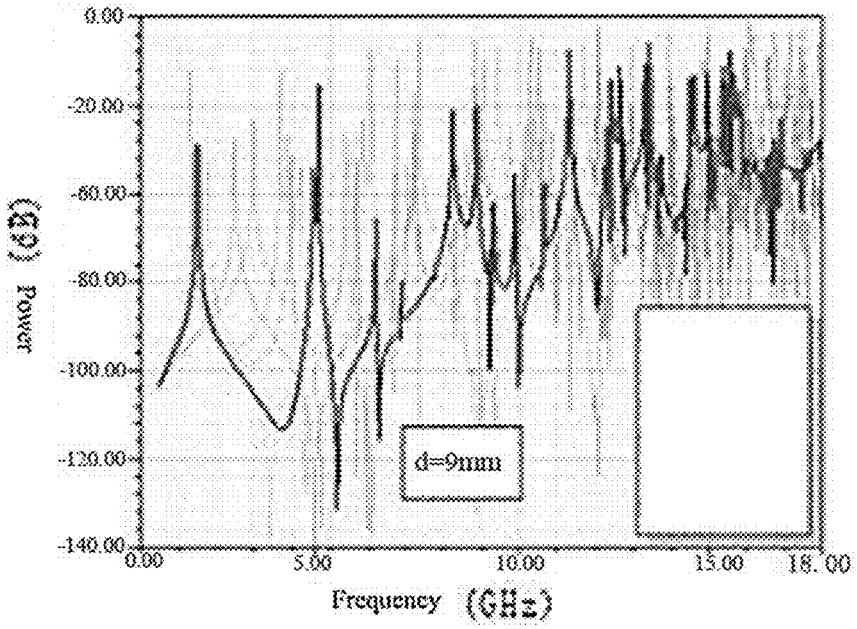
FIG. 10C is a schematic view showing the effect of thicknesses of a dielectric layer is 9 mm on the harmonics of the coaxial resonant cavity in accordance with an embodiment of the present disclosure.
Figure 10D:
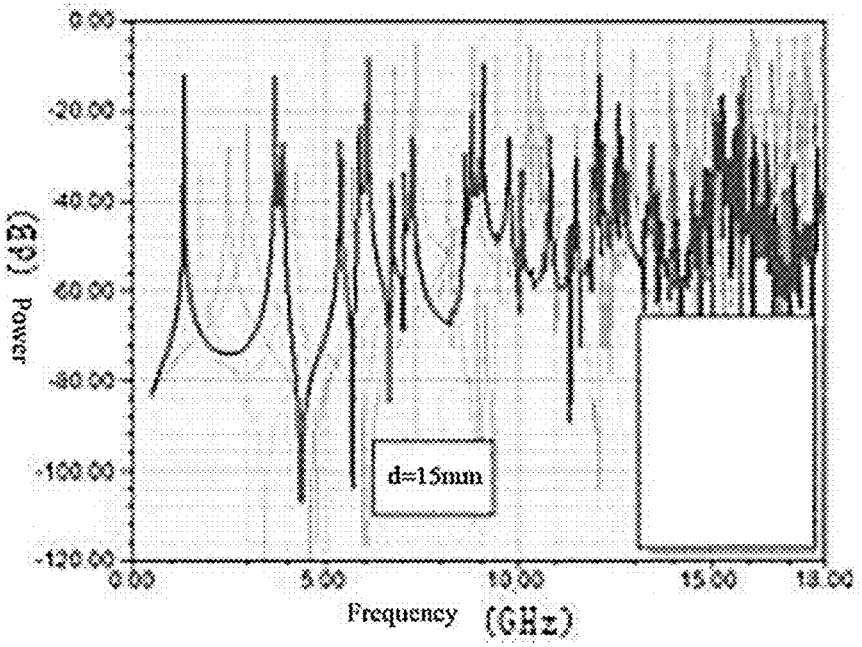
FIG. 10D is a schematic view showing the effect of thicknesses of a dielectric layer is 15 mm on the harmonics of the coaxial resonant cavity in accordance with an embodiment of the present disclosure.

When the ratio of the radius b of the outer conductor 12 to the radius a of the inner conductor 11 is n, simulation tests are carried out for the coaxial resonant cavity 10 based on n of different values, the result of which are shown in FIGS. 5 to 7.

A curve (a) in FIG. 5 indicates the microwave signal when n=2.5. Peaks of the curve (a) indicate the picked resonant frequencies of the coaxial resonant cavity 10, and, the sharper the corresponding peak is, the higher the quality factor is. Recessed portions of the curve (a) indicate frequency ranges which are filtered out. R1, R2, and R3 are respectively the fundamental wave, the third harmonic, and the fifth harmonic. Curves (b), (c), and (d) in FIG. 5 indicate the microwave signal when n=3.5, 5, and 6, respectively. It can be concluded that the fundamental wave, the third harmonic and the fifth harmonic respectively form a peak in each curve. When n=2.5, the peaks are relatively blunt, indicating that the quality factors are relatively low, when n=6, the clutter obviously increases and thus interferes with the peaks formed by the needed harmonics, the fundamental wave, the third harmonic, and the fifth harmonic. Thus, in an embodiment the ratio n of the radius b of the outer conductor 12 to the radius a of the inner conductor 11 can be 3.5 or 5.

FIG. 6 shows variations of resonant frequencies of the fundamental wave, the third harmonic, and the fifth harmonic as the ratio n increases, wherein F1 corresponds to the fundamental wave, F2 corresponds to the third harmonic, and F3 corresponds to the fifth harmonic. It can be concluded that the resonant frequency decreases as the ratio n increases. FIG. 7 shows variations of the quality factors of the fundamental wave, the third harmonic, and the fifth harmonic as the ratio n increases, wherein Q1 corresponds to the fundamental wave, Q2 corresponds to the third harmonic, and Q3 corresponds to the third harmonic. It can be concluded that the quality factors accordingly increases as the ratio of the radius of the outer conductor 12 to the radius a of the inner conductor 11 increases.

Thus, in order to obtain a high resonant frequency as well as a high quality factor, the ratio n of the radius of the outer conductor 12 to the radius of the inner conductor 11 can range from 3 to 5. In an embodiment, the ratio n can be 4.

Secondly, the effect of the radius of the inner conductor on the harmonics of the coaxial resonant cavity 10

Simulation tests, the results of which are shown in FIG. 8, are carried out based on that the inner conductor of the coaxial resonant cavity 10 has different radiuses.

The curves (a), (b), (c) and (d) in FIG. 8 indicate the microwave signal when the radius a=2 mm, 3 mm, 4 mm, and 5 mm, respectively.

It can be concluded that when the radius a of the inner conductor 11 is 2 mm, the peaks formed by the fundamental wave, the third harmonic, and the fifth harmonic have the best shapes, indicating high quality factors and the least clutter. In comparison with the curves of the microwave signal when the radius a of the inner conductor 11 is equal to 3 mm, 4 mm, or 5 mm, it can be concluded that the peaks formed by the fundamental wave, the third harmonic, and fifth harmonic at this situation have worse shapes, indicating low quality factors and relatively more clutter.

Thus, in order to obtain relatively high quality factors, the radius of the inner conductor 11 can be 2 mm.

Thirdly, the effect of the cavity length on the coaxial resonant cavity 10

Simulation tests are carried out for the coaxial resonant cavity 10 by adjusting the cavity length h, the results of which are shown in FIG. 9.

The curves (a), (b), (c), and (d) indicate the microwave signal when the cavity length h=10 mm, 17 mm, 24 mm, and 30 mm, respectively. It can be concluded that, when the cavity length h=10 mm, the peaks interfere with each other, and the resonant frequency decreases and the shapes of the peaks become better as the cavity length h increases.

In an embodiment, when the cavity length is adjusted within a range from 21 to 35 mm, the resonant frequency of the fundamental wave varies from 2 GHz to 4 GHz, the resonant frequency of the third harmonic varies from 6 GHz to 12 GHz, and the resonant frequency of the fifth harmonic varies from 10 GHz to 20 GHz. Thus, when the cavity length is within a range from 21 to 35 mm, the resonant frequency range of the coaxial resonant cavity 10 is accordingly from 2 GHz to 20 GHz.

Fourthly, the effect of the thickness of the dielectric layer 16 on the coaxial resonant cavity 10

Figure 11:
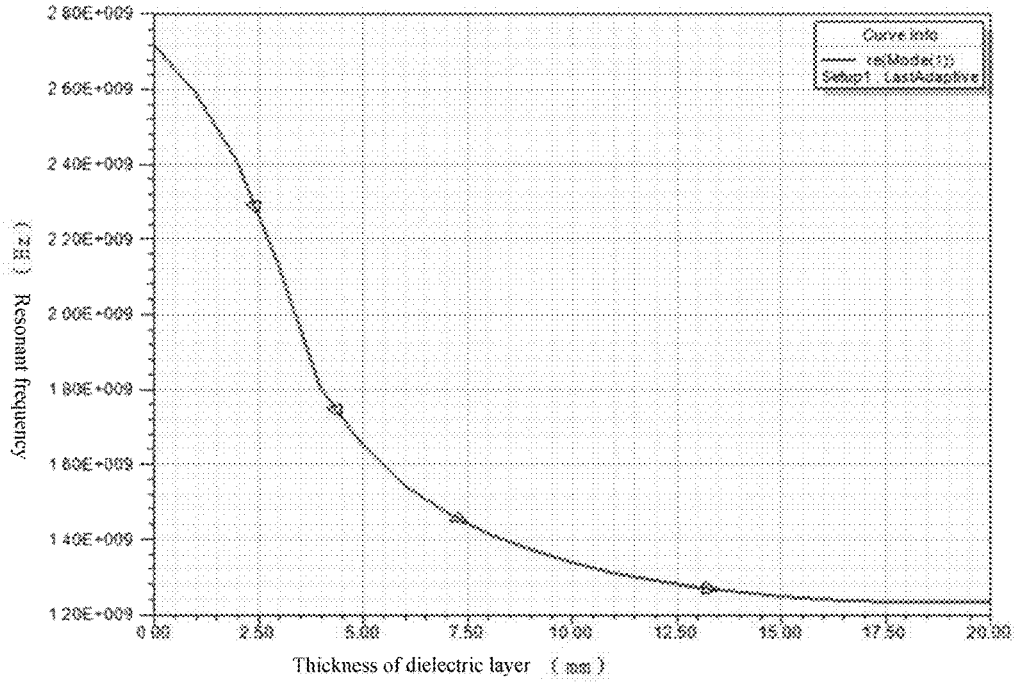
FIG. 11 is a schematic view showing the variation of the resonant frequency of the fundamental harmonic of the coaxial resonant cavity as the thickness of the dielectric layer increases in accordance with an embodiment of the present disclosure.
Figure 12:
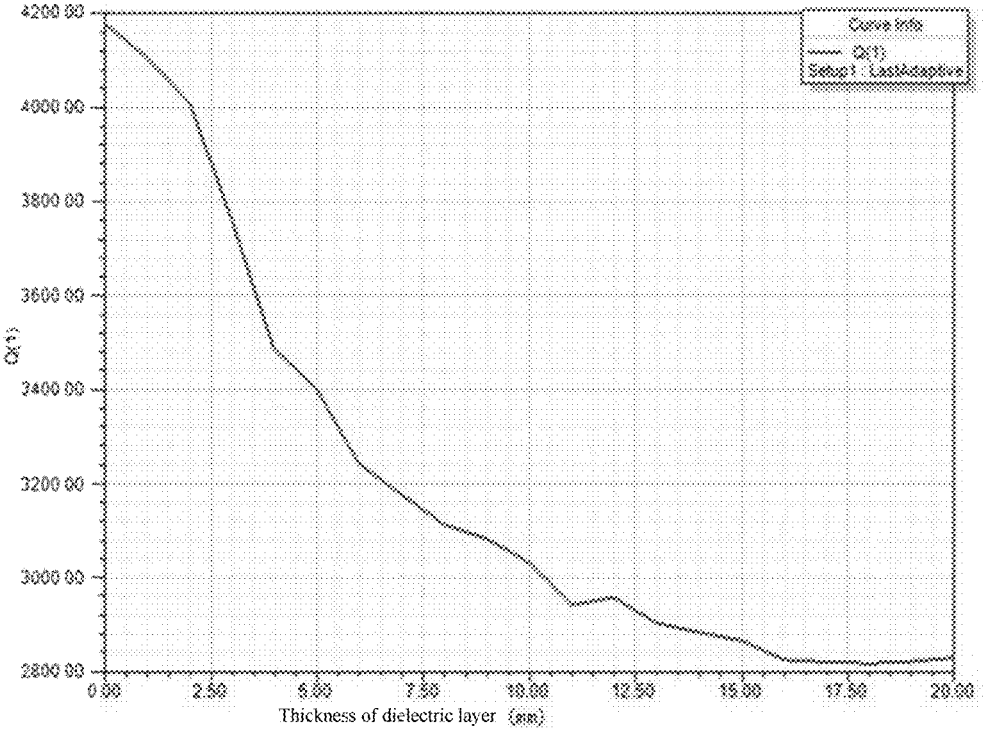
FIG. 12 is a schematic view showing the variation of the quality factor of the fundamental harmonic of the coaxial resonant cavity as the thickness of the dielectric layer increases in accordance with an embodiment of the present disclosure.

Simulation tests, the result of which are shown in FIGS. 10 to 12, are carried out for the coaxial resonant cavity 10 based on that the coaxial resonant cavity 10 is configured with the dielectric layer 16 of different thicknesses, respectively.

The curves (a), (b), (c), and (d) in FIG. 10 indicate the microwave signal when the thickness d is equal to 0 mm, 3 mm, 9 mm, and 15 mm, respectively. From FIG. 10, it can be concluded that, the smaller the thickness of the dielectric layer 16 is, the higher the resonant frequency is and the less the clutter is; the higher the thickness of the dielectric layer 16 is, the lower the resonant frequency of the coaxial resonant cavity 10 is and the more the clutter is.

The curve in FIG. 11 shows the variation of the resonant frequency of the fundamental wave with the thickness of the dielectric layer 16. It can be obviously seen that the resonant frequency of the coaxial resonant cavity 10 decreases as the thickness of the dielectric layer 16 increases. The curve FIG. 12 shows the variation of the quality factor of the fundamental wave with thickness of the dielectric layer 16. From FIG. 12, it can be concluded that the quality factor of the coaxial resonant cavity 10 decreases as the thickness of the dielectric layer 16 increases.

Thus from FIGS. 10 to 12, in order to reduce the resonant frequency and ensure relatively high quality factor, the thickness of the dielectric layer 16 can be 5 mm in an embodiment. In this embodiment, the dielectric layer 16 is made of aluminum oxide. In other embodiments where the dielectric layer 16 is made of other materials, the thickness of the dielectric layer 16 is accordingly adjusted.

As stated above, when the dielectric layer 16 is made of aluminum oxide and the thickness of the dielectric layer 16 is 5 mm, the resonant frequency range of the coaxial resonant cavity 10 is from 1 GHz to 20 GHz.

Fifthly, the effect of the radius of the coupling ring on the harmonics of the coaxial resonant cavity 10

Two of the coupling rings are symmetrically arranged inside the coaxial resonant cavity 10 about the axis of the coaxial resonant cavity 10. Simulation tests, the results of which are shown in FIG. 13, are carried out for the coaxial resonant cavity 10 based on that the coupling ring has different radiuses.

Figure 13:
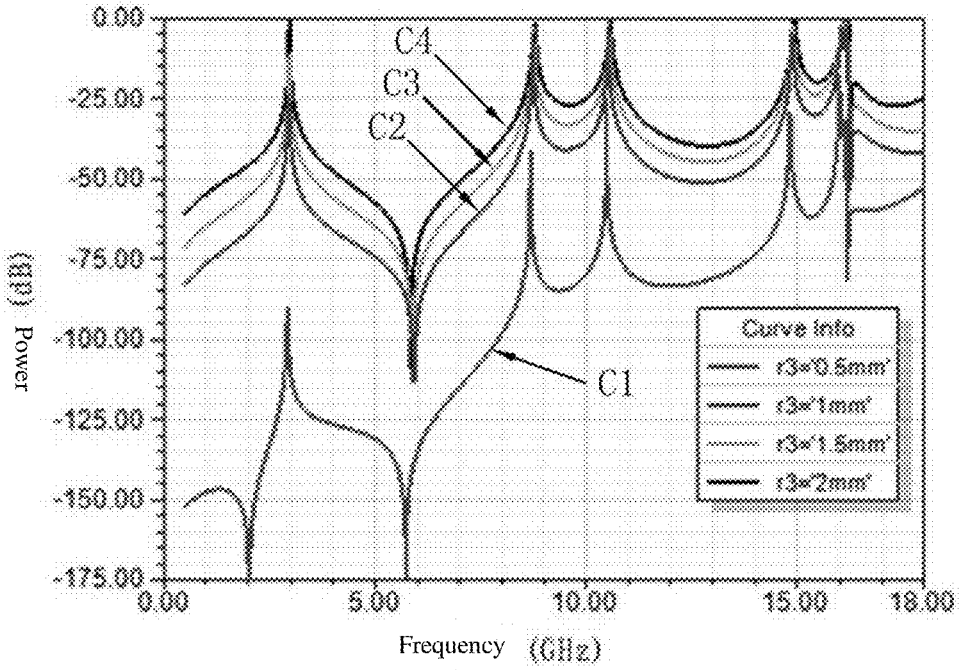
FIG. 13 is a schematic view showing the effect of different radiuses of a coupling ring on the harmonics of the coaxial resonant cavity in accordance with an embodiment of the present disclosure.

The curves C1, C2, C3, and C4 in FIG. 13 show the microwave signal when the radius c of the coupling ring is equal to 0.5 mm, 1 mm, 1.5 mm and 2 mm respectively.

It can be concluded from FIG. 13 that the variation of the radius c of the coupling ring almost has no effect on the resonant frequencies of the coaxial resonant cavity 10. However, the quality factors increase as the radius c of the coupling ring decreases. When the radius c of the coupling ring is equal to 0.5 mm, clutter arises around the fundamental wave.

Therefore, in order to ensure relatively high quality factors and avoid arising of the clutter, the radius c of the coupling ring can be 1 mm in an embodiment.

As stated above, the structure of the coaxial resonant cavity 10 can be verified and the optimum configuration of the structure can be determined through verifications. In an embodiment, the radius a of the inner conductor 11 is 2 mm, the radius b of the outer conductor 12 is 8 mm, and the cavity length h ranges from 21 to 35 mm, the dielectric layer 16 is made of aluminum oxide and has a thickness d of 5 mm, and two of the coupling rings are provided and each has a radius of 1 mm. In this embodiment, the resonant frequency range of the coaxial resonant cavity 10 is from 1 GHz to 20 GHz, and the quality factor is high.

The coaxial resonant cavity 10 of the above embodiments can be applied in a system 100 for measuring the dielectric constant of a material, a microwave flaw detection device, a filter, and a microwave sterilization device.

A second embodiment of the present disclosure provides the system 100 for measuring the dielectric constant of a material.

When the cavity body 19 of the coaxial resonant cavity 10 keeps unchanged, the resonant frequency and the quality factor of the coaxial resonant cavity 10 are fixed. After a sample is placed, the resonant frequency and the quality factor of the coaxial resonant cavity 10 are varied. Electromagnetics properties of the sample such as the dielectric constant, a permittivity loss, an electric conductivity and a magnetic permeability of the sample can be calculated through the variation of the resonant frequency and quality factor, among which the dielectric constant is the most important property.

Figure 14:
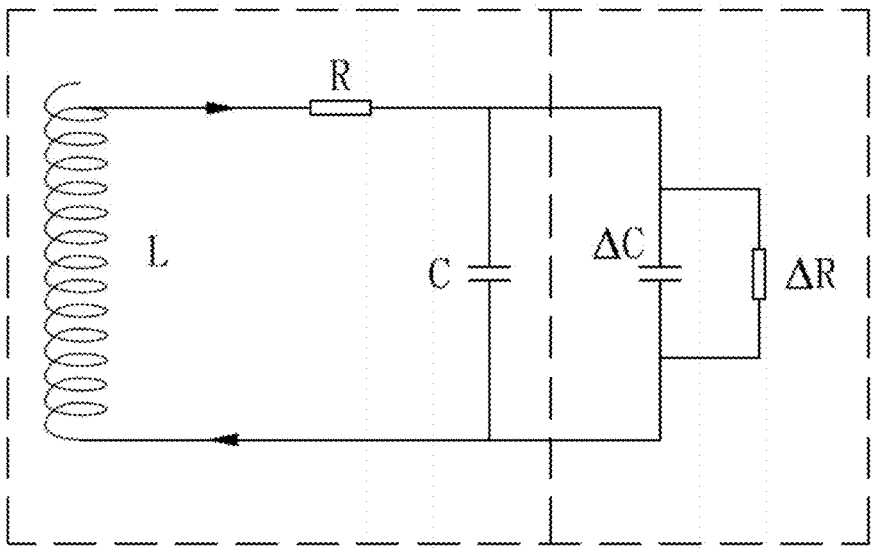
FIG. 14 is a schematic view of an equivalent circuit of the coaxial resonant cavity in accordance with an embodiment of the present disclosure.

2.1 The Measuring Principle of the System 100 for Measuring the Dielectric Constant of a Material An equivalent circuit of the coaxial resonant cavity 10 is a RLC series circuit as the portion in the left dotted box in FIG. 14. The resonant frequency and the quality factor of the coaxial resonant cavity 10 can be expressed as:

$$f=(LC)^{-1/2}/2\pi \tag{6}$$

$$Q=(LC)^{1/2}/R \tag{7}$$

wherein f is the resonant frequency, Q is the quality factor, L is an inductance, C is a capacitance, and R is a resistance. Since the capacitance C is related to a size of the cavity body 19 of the coaxial resonant cavity 10, the resonant frequency and the quality factor of the coaxial resonant cavity 10 may be affected respectively by the radius of the inner conductor 11, the radius of the outer conductor 12, and the cavity length. Generally, a high resonant frequency of the coaxial resonant cavity 10 can be obtained by reducing the size of the coaxial resonant cavity 10.

Figure 15:
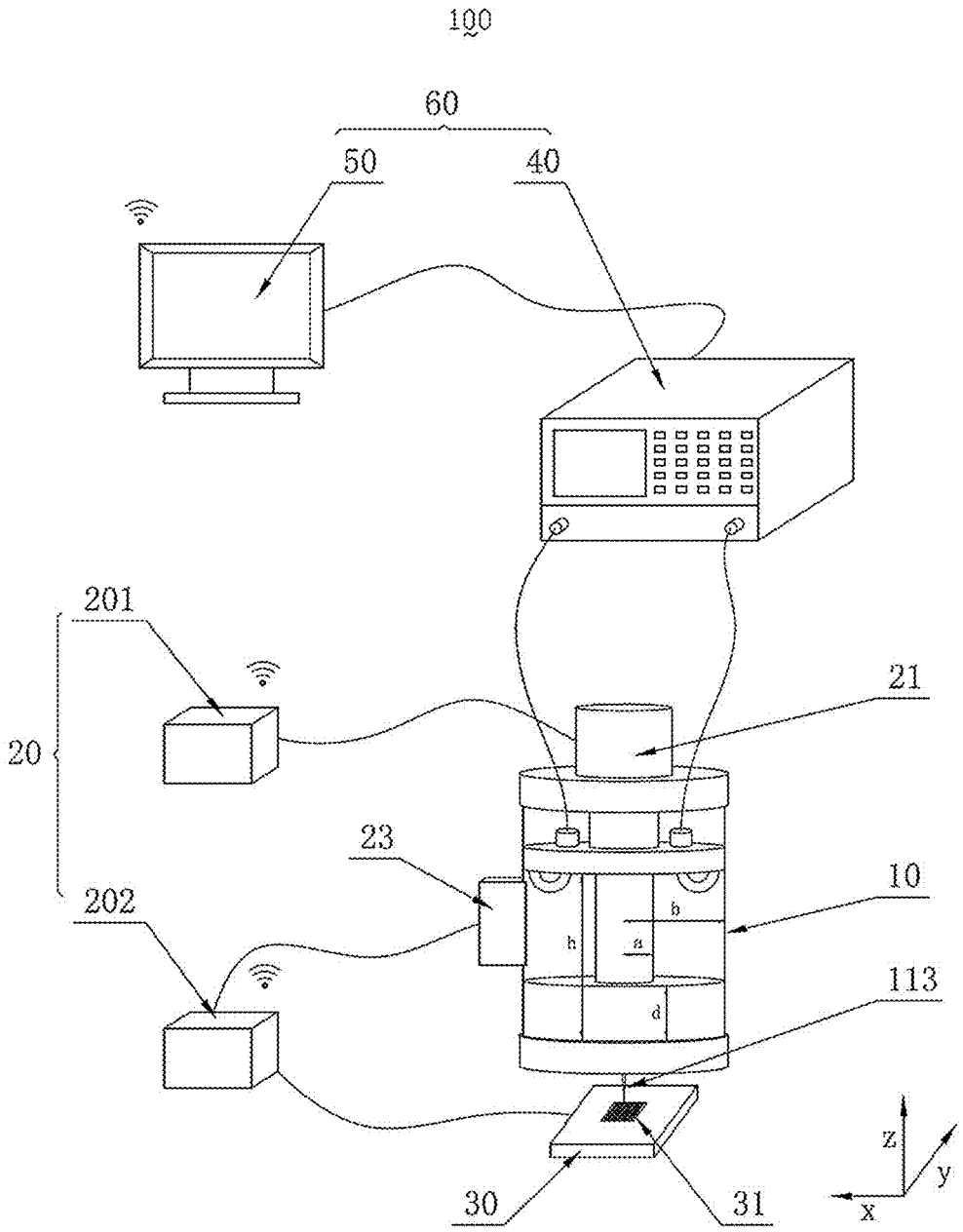
FIG. 15 is a schematic view of the system for measuring the dielectric constant of a material in accordance with an embodiment of the present disclosure.

As shown in FIG. 15, the sample 31 is placed at the tip point of the probe 113; the sample 31 is located in the electromagnetic field formed by the tip point of the probe 113 and thus interferes with the formed electromagnetic field. The sample 31 is generally located on the axis of the probe 113, and a distance between the sample 31 and the probe 113 is less than 3 um to ensure that the sample 31 is located in the electromagnetic field formed by the tip point of the probe 113.

Due to the interference from the sample 31, the equivalent circuit of the coaxial resonant cavity 10 is changed to be a RLC parallel circuit from a RLC series circuit as the dotted box in FIG. 14, introducing a circuit as the portion in the right dotted box shown in FIG. 14. Thus, after the placement of the sample, the capacitance C and the resistance R of the equivalent circuit are varied, and thus the resonant frequency f and the quality factor Q of the coaxial resonant cavity 10 are accordingly varied.

The variations of the resonant frequency f and the quality factor Q of the coaxial resonant cavity 10 caused by the sample 31 are related to the electromagnetics properties of the sample 31, which can be derived using the perturbation theory. There are two types of perturbations, one refers to the slight variation of the dielectric constant inside the whole cavity, and the other refers to the situation that the dielectric constant in a small area inside the cavity varies while the dielectric constant in other areas thereof keeps unvaried. Fields before and after the perturbation satisfy the Maxwell equation and boundary conditions.

Before the perturbation:

$$\nabla\times\vec{E}_0=-j\,\omega_0\mu_0\vec{H}_0 \tag{8}$$

$$\nabla\times\vec{H}_0=j\,\omega_0\varepsilon_0\vec{E}_0 \tag{9}$$

$$\vec{n}\times\vec{E}_0=0 \tag{10}$$

wherein $\vec{E}_0$ is the electric field inside the coaxial resonant cavity 10 before the perturbation, $\vec{H}_0$ is the magnetic field inside the coaxial resonant cavity 10 before the perturbation, $\omega_0$ is the resonant frequency inside the coaxial resonant cavity 10 before the perturbation, $\mu_0$ is the magnetic permeability inside the coaxial resonant cavity 10 before the perturbation, $\varepsilon_0$ is the dielectric constant inside the perturbation, and $\vec{n}$ is a unit normal vector inside the coaxial resonant cavity 10 before the perturbation.

After the perturbation:

$$\nabla\times\vec{E}=-j\omega(\mu+\Delta\mu)\vec{H} \tag{11}$$

$$\nabla\times\vec{H}=j\omega(\varepsilon+\Delta\varepsilon)\vec{E} \tag{12}$$

$$\vec{n}\times\vec{E}=0 \tag{13}$$

wherein $\vec{E}$ is the electric field inside the coaxial resonant cavity 10 after the perturbation, $\vec{H}$ is the magnetic field inside the coaxial resonant cavity 10 after the perturbation, $\omega$ is the resonant frequency inside the coaxial resonant cavity 10 after the perturbation, $\Delta\mu$ is an increment of the magnetic permeability introduced by the perturbation, and $\Delta\varepsilon$ is an increment of the dielectric constant introduced by the perturbation.

Similar to the derivation of the perturbation on a cavity wall, a following perturbation formula can be obtained:

$$\frac{\omega-\omega_0}{\omega_0}=-\frac{\int_{\Delta V}(\Delta\varepsilon|E_0|^2+\Delta\mu|H_0|^2)dV}{\int_V(\varepsilon_0|E_0|^2+\mu_0|H_0|^2)dV}=-\frac{\int_{\Delta V}(\Delta\varepsilon|E_0|^2+\Delta\mu|H_0|^2)dV}{4W} \tag{14}$$

The dielectric constant $\varepsilon_r$ and the magnetic permeability $\mu_r$ can be calculated through the above formula.

Lossy dielectrics also satisfy the above formula, however, the dielectric constant and the resonant frequency are complex numbers:

$$\mu=\mu 0\quad \Delta\mu=0 \tag{15}$$

$$\varepsilon=\varepsilon_0(\varepsilon'-j\varepsilon'') \tag{16}$$

-continued $$\omega_0' = \omega_0 + j\frac{\omega_0}{2Q_0} \tag{17}$$

$$\omega' = \omega + j\frac{\omega}{2Q} \tag{18}$$

$$\frac{\omega + j\frac{\omega}{2Q} - \omega_0 - j\frac{\omega_0}{2Q_0}}{\omega + j\frac{\omega}{2Q}} = \frac{-\varepsilon_0(\varepsilon' - 1 - j\varepsilon'')\int_{\Delta V}|\vec{E}_0|^2 dV}{\int_V(\varepsilon_0|E_0|^2 + \mu_0|H_0|^2)dV} \tag{19}$$

wherein μ is the magnetic permeability inside the coaxial resonant cavity 10 after the perturbation, E is the dielectric constant inside the coaxial resonant cavity 10 after the perturbation, ε' is a real part of the dielectric constant, ε" is an imaginary part of the dielectric constant, $Q_0$ is the quality factor inside the coaxial resonant cavity 10 before the perturbation, and Q is the quality factor after the perturbation inside the coaxial resonant cavity 10.

The above formula can be divided into two formulas:

$$\frac{\omega - \omega_0}{\omega_0} = -\varepsilon_0(\varepsilon' - 1)\frac{\int_{\Delta V}|\vec{E}_0|^2 dV}{4W} \tag{20}$$

$$\frac{1}{2Q} - \frac{1}{2Q_0} = \varepsilon_0\varepsilon''\frac{\int_{\Delta V}|\vec{E}_0|^2 dV}{4W} \tag{21}$$

The relationship among the dielectric constant, the resonant frequency, and the quality factor thus can be obtained. It can be concluded that the real part and the imaginary part of the dielectric constant of the lossy dielectric results in a deviation of the resonant frequency and the variation of the quality factor, respectively. Thus, the dielectric constant of the sample 31 can be calculated by the formulas (20) and (21) through the resonant frequency and the quality factor measured before and after the perturbation, that is, the perturbation inside the coaxial resonant cavity 10 caused before and after the perturbation.

Figure 16:
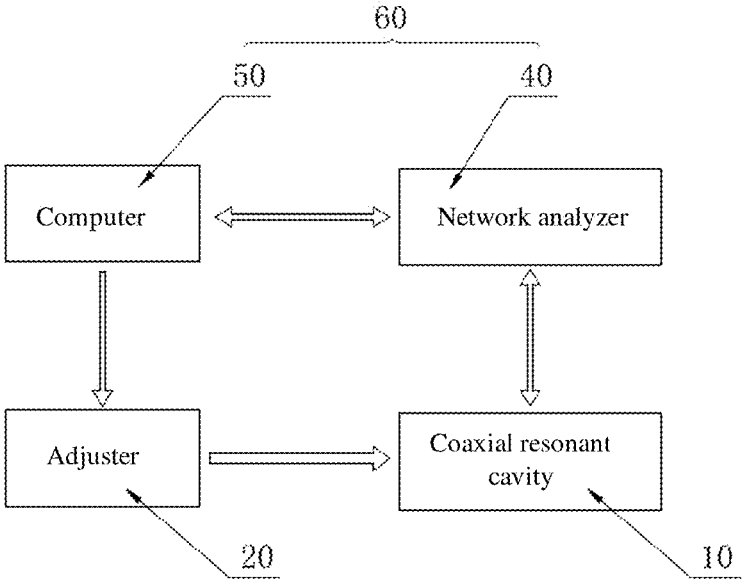
FIG. 16 is a schematic view of the controlling principle of the system for measuring the dielectric constant of a material in accordance with an embodiment of the present disclosure.

2.2 Specific Structure of the System 100 for Measuring the Dielectric Constant of a Material Referring FIGS. 15, 16, and 1, the system 100 includes the coaxial resonant cavity 10 and a control system 60. The control system 60 is capable of performing the input, output, and analysis of the microwave signal, the resonant frequency of the coaxial resonant cavity 10 is used as a measuring frequency of the system 100, and the resonant frequency range is used as a measuring range of the system 100. The system 100 has a high measuring accuracy when the coaxial resonant cavity 10 has a high quality factor and a relatively little clutter.

In an embodiment, the control system 60 includes a network analyzer 40 and a computer 50; the network analyzer 40, that is, the microwave signal generator or the microwave signal receiver mentioned above, is configured for inputting, outputting and analyzing the microwave signal. The computer 50 is configured for providing a human machine interface, controlling the network analyzer, and calculating corresponding data to obtain the dielectric constant of the material.

In an embodiment the coaxial resonant cavity 10 is connected to the network analyzer 40 and the network analyzer 40 is connected to the computer 50, such that the computer 50 can control the network analyzer 40 and acquire the data analyzed by the network analyzer 40 and the analysis result. Due to the wide resonant frequency range of the analyzer 40, the system 100 has a wide measuring frequency range. In addition, since the system 100 measures the sample 31 through the probe 113, the measuring speed of the system 100 is rapid.

In an embodiment, the system 100 further includes an adjuster 20 capable of adjusting the resonant frequency of the coaxial resonant cavity 10 and a position relationship between the coaxial resonant cavity 10 and the sample 31. The adjuster 20 is controlled by the computer 50. The adjuster 20 can be connected to the computer 50 through a cable or wirelessly such as through Bluetooth or a Wifi network. In an embodiment, the adjuster 20 includes a first adjuster 201 and a second adjuster 202. The first adjuster 201 is connected to the actuator 21 for varying the resonant frequency of the coaxial resonant cavity 10 by varying the cavity length. The second adjuster 202 is connected to a sample placement table 30 for moving the sample placement table 30 and thus adjusting the position relationship between the sample 31 and the probe 113.

In an embodiment, the second adjuster 202 is connected to the movable blocker 23 which is capable of driving the coaxial resonant cavity 10 to move along the axial direction of the coaxial resonant cavity 10, that is, along the z axis as shown in FIG. 14. The sample placement table 30 moves across a plane perpendicular to the axis of the coaxial resonant cavity 10, that is, moves across the xy plane along the x and y axes. Thus the position relationship between the coaxial resonant cavity 10 and the sample 31 can be rapidly and accurately adjusted.

Figure 17:
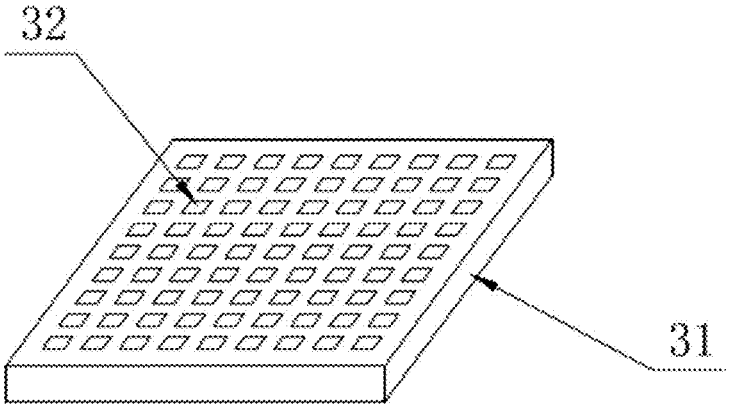
FIG. 17 is a schematic view of a sample for the system for measuring the dielectric constant of a material in accordance with an embodiment of the present disclosure.

In an embodiment, as shown in FIG. 17, the sample 31 can be a combined one having several sub-samples 32. The sub-samples 32 can be arranged as an array. The sub-samples 32 are located in the electromagnetic field formed by the probe 113 by moving the sample placement table 30, thus, the system 100 can rapidly measure all the sub-samples 32, enabling high a throughout experiment of the material. Moreover, since the dielectric constant of the material is closely related to the measuring frequency, the measured dielectric constant of the sub-samples 32 varies with the measuring frequency. Thus, the coaxial resonant cavity 10 of the first embodiment can fully cover the frequency range from 1 to 20 GHz, to provide more comprehensive and accurate measuring data and thus is applicable in screening of large amount of materials.

From formulas (20) and (21), the resonant frequency and the quality factor of the coaxial resonant cavity 10 before perturbation are used during calculation. Since the resonant frequency and the quality factor of the coaxial resonant cavity 10 when the coaxial resonant cavity 10 is in a hollow state have fixed values, thus, the system 100 further includes a database having a collection of data corresponding to a hollow state of the coaxial resonant cavity 10, that is, before the perturbation caused by the sample. That is, the database stores the resonant frequencies and quality factors of the fundamental wave, the third harmonic, and the fifth harmonic corresponding to different cavity lengths, different dielectric layers 16, and different thicknesses of the dielectric layer 16 respectively. In this way, the resonant frequency and quality factor of the coaxial resonant cavity 10 can be directly measured after the placement of the sample 32, and the resonant frequency and the quality factor of the coaxial resonant cavity 10 when the coaxial resonant cavity 10 is in a hollow state can be retrieved from the database, which improves the measuring speed and thus improves the measuring efficiency.

In addition, since the dielectric constant of the material varies over frequencies, applications of the material need to be considered before the measurement of the material such that the dielectric constant of the material under a certain frequency can be measured pertinently. Thus, the database can be used for rapid setting of the resonant frequency of the coaxial resonant cavity 10, which enables a pertinent measurement of the material and thus improves the measuring efficiency.

Figure 18:
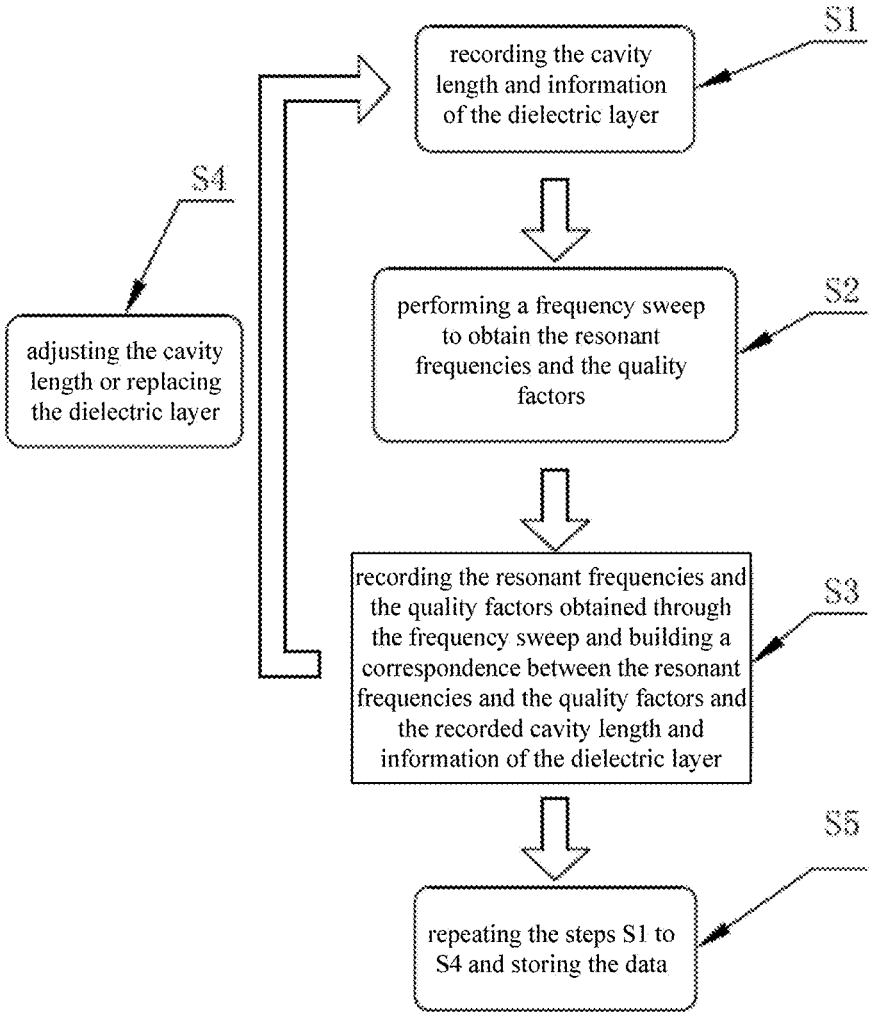
FIG. 18 is a flow chart showing the process of establishing a database of the system for measuring the dielectric constant of a material in accordance with an embodiment of the present disclosure.
Figure 19:
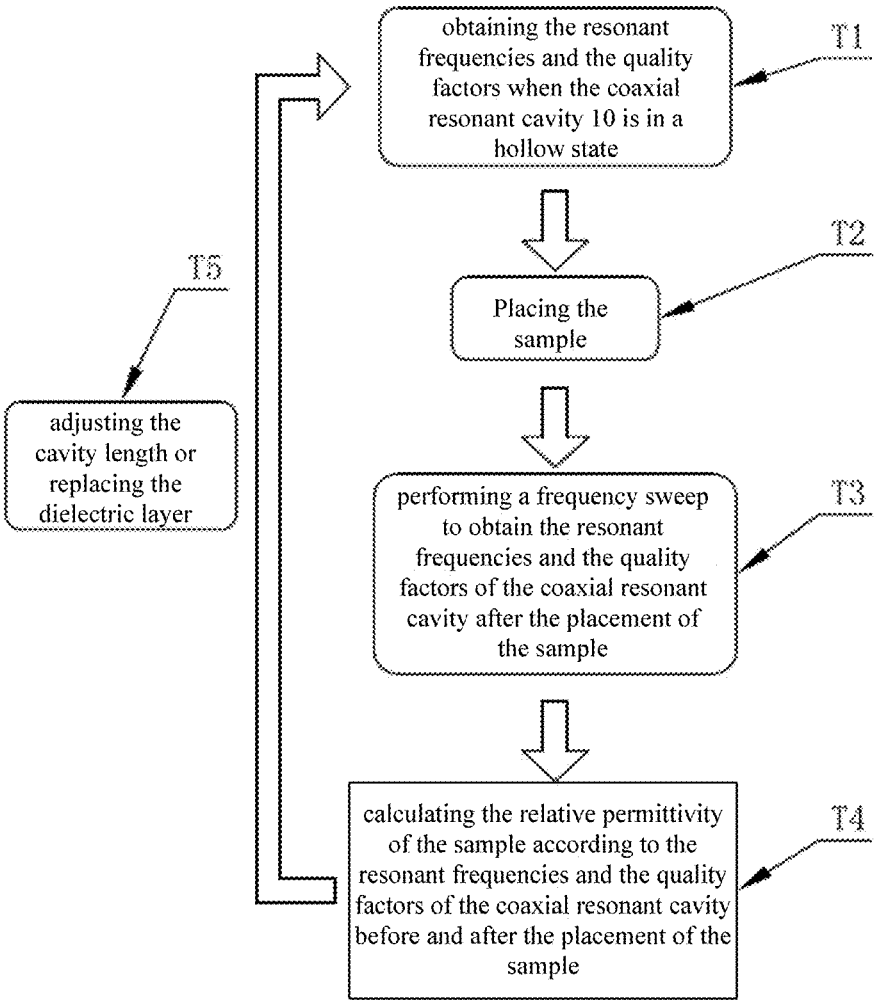
FIG. 19 is a flow chart of a method for measuring the dielectric constant of a material in accordance with an embodiment of the present disclosure.

The process of establishing the database is shown in FIG. 18, including steps as follows.

Step S1, recording the cavity length and information of the dielectric layer. The information of the dielectric layer includes a material of the dielectric layer and the thickness of the dielectric layer. The current cavity length and the information of the dielectric layer are recorded through the computer.

Step S2, performing a frequency sweep to obtain the resonant frequencies and the quality factors. The resonant frequencies and the quality factors of the fundamental wave, the third harmonic, and the fifth harmonic are obtained through the frequency sweep by the network analyzer, and the network analyzer transmits the measured information to the computer.

Step S3, recording the resonant frequencies and the quality factors obtained through the frequency sweep and building a correspondence between the resonant frequencies and the quality factors and the recorded cavity length and information of the dielectric layer. That is, the resonant frequencies and the quality factors measured in step S2 are recorded and corresponded to the cavity length and the information of the dielectric layer recorded in step S1.

Step S4, adjusting the cavity length or replacing the dielectric layer. The cavity length and the dielectric layer are adjusted for the next group of measurements.

Step S5, repeating the steps S1 to S4 and storing the data. The above steps are repeated and the data obtained through the above steps are stored. The stored data includes the resonant frequencies and the quality factors of the fundamental wave, the third harmonic, and the fifth harmonic corresponding to different cavity lengths, different materials of the dielectric layer, and different thicknesses of the dielectric layer, respectively. The storage of the data forms the database.

2.3 A Measuring Method Based on the System 100 for Measuring the Dielectric Constant of a Material The measuring method based on the system 100 includes steps as follows.

Step T1, obtaining the resonant frequencies and the quality factors when the coaxial resonant cavity 10 is in a hollow state. In this step, the resonant frequencies and the quality factors of the coaxial resonant cavity 10 before the placement of the sample are obtained, including the resonant frequencies and the quality factors of the fundamental wave, the third harmonic, and the fifth harmonic.

When the system 100 includes the database, the computer can, based on the current cavity length and the information of the dielectric layer, directly extract the resonant frequencies and the quality factors when the coaxial resonant cavity 10 is in a hollow state from the database, which improves the measuring speed and the measuring efficiency. In some embodiments, the resonant frequencies and the quality factors can be obtained through a frequency sweep performed when the coaxial resonant cavity 10 is in a hollow state.

Step T2, placing the sample. In this step, the sample is placed at the tip point of the probe 113 of the coaxial resonant cavity 10 such that the sample is located in the electromagnetic field formed by the tip point of the probe 113. If the sample is a combined one, an adjusting instruction is sent to the adjuster through the computer such that different sub-samples can be moved to the tip point of the probe and be located in the electromagnetic field formed by the tip point. Thus, all the sub-samples can be measured in order quickly.

Step T3, performing a frequency sweep to obtain the resonant frequencies and the quality factors of the coaxial resonant cavity after the placement of the sample. The resonant frequencies and the quality factors of the fundamental wave, the third harmonic, and the fifth harmonic are obtained through the frequency sweep performed by the network analyzer and are transmitted to the computer through the network analyzer.

Step T4, calculating the dielectric constant of the sample according to the resonant frequencies and the quality factors of the coaxial resonant cavity before and after the placement of the sample. The dielectric constant of the sample is calculated through the formulas (20) and (21) via the resonant frequencies and the quality factors obtained in step T3 and when the coaxial resonant cavity is in a hollow state.

When the measurement of the dielectric constant of the sample under multiple frequencies is required, the method can further include a step T5: adjusting the cavity length or replacing the dielectric layer. Generally speaking, it is more quick and convenient to adjust the cavity length, while the replacement of the dielectric layer can further reduce the resonant frequency. After the execution of step T5, the steps from T1 to T4 are repeated to obtain the dielectric constant of the sample under different frequencies. In some embodiments, when the measurement of the dielectric constant of the sample under a certain frequency is required, the relatively permittivity can be obtained by: obtaining the cavity length and the information of the dielectric layer corresponding to the certain frequency from the database, adjusting the cavity length or replacing the dielectric layer according to the information obtained from the database, and repeating the steps from T1 to T4.

The system 100 for measuring the dielectric constant of a material and the measuring method have advantages as follows.

(1) With the system 100 for measuring the dielectric constant and the measuring method provided in the present disclosure, only the resonant frequency and the quality factor of the coaxial resonant cavity 10 are required to be measured, and the dielectric constant of the sample can be calculated through two formulas based on the measured resonant frequency and the quality factor, thus, the data processing is simple and the measuring efficiency is high.

(2) In the system 100 for measuring the dielectric constant of a material and the measuring method, a sweeping detection is performed through the probe 113 of the coaxial resonant cavity 10 in which the sample to be measured is only required to be placed in the electromagnetic field outside the coaxial resonant cavity 10 formed by the probe 113. Since the sample to be measured is placed outside the coaxial resonant cavity 10, the operation is convenient and quick to effectively improve the measuring speed. Thus, large amount of samples can be measured in a short time to enable a high throughout experiment of the material.

In an embodiment, the ratio of the outer radius to the inner radius of the annular column is (3-5):1. There is a little clutter around the higher harmonics of the coaxial resonant cavity, and the higher harmonics have relatively high quality factors, thereby ensuring the measuring accuracy. The resonant frequencies of the higher harmonics are obviously higher than the resonant frequency of the fundamental wave.

Therefore, through the system 100 for measuring the dielectric constant of a material and the measuring method provided in the present disclosure, the dielectric constant of the sample under three frequencies can be obtained after one time measuring, including the measuring results of the three frequency measuring points corresponding to the fundamental wave, the third harmonic, and the fifth harmonic. This not only improves the measuring efficiency, but also provides a wide arrangement of measuring points. Thus, the variation of the dielectric constant of the sample 31 within the measuring range can be roughly obtained through one measurement.

In an embodiment, when the system 100 further includes the database, the system 100 and the measuring method are capable of improving the measuring speed and the measuring efficiency.

In an embodiment, a height of the cavity body 19 of the coaxial resonant cavity 10 is adjustable and the height of the cavity body 19 is greater than the sum of the outer radius and the inner radius of the annular column of the cavity body 19. The resonant frequency of the coaxial resonant cavity 10 varies with the height of the cavity body 19, and the variation range of the height of the cavity body 19 is the same as the resonant frequency range of the coaxial resonant cavity 10. Thus, the dielectric constant of the sample 31 to be measured corresponding to different resonant frequencies within the resonant frequency range can be obtained by adjusting the height of the cavity body 19 without replacing the sample 31. In other words, the value of the dielectric constant varying with the frequency can be obtained quickly and completely, which facilitates to determine the application of the sample 31 in the microwave technology field. In addition, since the ratio of the outer radius to the inner radius of the annular column of the cavity body 19 is fixed, a wide resonant frequency range of the coaxial resonant cavity 10 is obtained due to the high resonant frequency of the coaxial resonant cavity 10. Clutter around the higher harmonics can be avoided to ensure a high measuring accuracy by controlling the height of the cavity body 19 to be greater the sum of the outer radius and the inner radius of the annular column of the cavity body 19.

Therefore the system 100 and the measuring method are applicable in high throughout measurements due to advantages including a high measuring efficiency, a rapid speed, a wide measuring range, and a high measuring accuracy and so on.

A microwave flaw detection device is provided in accordance with a third embodiment of the present disclosure.

The present disclosure provides the microwave flaw detection device with the above coaxial resonant cavity. The sample can be placed at the tip point of the probe of the coaxial resonant cavity, thus, the measuring speed is high. The interaction between the sample and the tip point varies the resonant frequency and the quality factor of the coaxial resonant cavity, thus, the measurement of the sample can be finished based on the variations of the resonant frequency and the quality factor of the coaxial resonant cavity. Although microwaves have a good directionality and a good ability to penetrate dielectric material, microwaves cannot pass through metal and materials of good electric conductivities. Thus microwaves can be used for detecting flaws inside the sample and obtains images of the interior structure of sample based on detected data. The measuring result is accurate.

The structure of the microwave flaw detection device is similar to that of the system 100 of the second embodiment; the only difference therebetween lies in that software configured in the computer is different. This is because data processing process and calculation process of the microwave flaw detection device are different from those of the system 100 due to different principles.

A filter is provided in accordance with a fourth embodiment of the present disclosure.

The present disclosure provides the filter with the above coaxial resonant cavity 10. The filter performs filtering through the frequency selection function of the coaxial resonant cavity 10. A center frequency of the filter is the resonant frequency of the coaxial resonant cavity 10, and a bandwidth thereof depends on the quality factor of the coaxial resonant cavity 10. Since the coaxial resonant cavity 10 has a wide resonant frequency range, the filter has a wide frequency range. The resonant frequency and the quality factor vary with the cavity length of the coaxial resonant cavity 10, thereby adjusting the center frequency and the bandwidth of the filter and allowing the filter to be adjustable. In addition, the resonant frequency and the bandwidth of the filter can be adjusted according to actual requirements of filtering effect by adjusting the cavity length and the dielectric layer of the coaxial resonant cavity using database established in the second embodiment.

A microwave sterilization device is provided in accordance with a fifth embodiment of the present disclosure.

The present disclosure provides the microwave sterilization device with the above coaxial resonant cavity 10. The strong electric field formed at the tip point of the probe 113 of the coaxial resonant cavity 10 can be used for sterilization.

The principle of the microwave sterilization device is as follows. When the electromagnetic field is applied to the cell membrane lasting for a duration of microseconds to milliseconds, that is, lasting for a duration of 1 to 1000 microseconds, and the strength of the electromagnetic field reaches the level of kV/cm, the electric conductivity of the cell membrane is changed; meanwhile, pores appear in the cell membrane, resulting in the losing of barrier function of the cell membrane and thus the leakage of interior substance of the cell. Absorption of macromolecules thus increases. This is the so-called electroporation of the cell membrane. The electroporation of the cell membrane can be divided to a reversible electroporation and an irreversible electroporation according to the strength and acting time of the applied electric field. Electroporation is one kind of biophysics phenomena having advantages such as high efficiency, no leftover poisons, and easy control of parameters.

In an embodiment, when the coaxial resonant cavity 10 provided in the present disclosure performs magnetic coupling using the coupling ring 14 after the microwaves transmit as TEM waves inside the cavity body 19 over one quarter of a period, the magnetic field becomes the weakest while the electric field becomes the strongest. The electric field at the enclosed end 123 of the coaxial resonant cavity 10 becomes the strongest and forms a strong electric field outside the cavity body through the probe 113 by moving the slider 124 or change the wavelength of the imputing microwaves to make the cavity length h is ¼ wavelength of the inputing microwaves. The strength of the electric field may reach 10 kV/cm. Thus, the microwave sterilization device has a good sterilization effect.

Compared with the prior art, when the ratio of the outer radius to the inner radius of the annular column is (3-5):1, there is a little clutter around the higher harmonics and the higher harmonics have relative high quality factors. Since the resonant frequencies of the higher harmonics are obviously higher than the resonant frequency of the fundamental wave, thus, the resonant frequency can be effectively improved by controlling the ratio of the outer radius to the inner radius of the annular column of the cavity body without reducing the size of the coaxial resonant cavity.

Furthermore, the height of the cavity body is adjustable; the resonant frequency of the coaxial resonant cavity varies as the height of the cavity body is adjusted within the resonant frequency range of the coaxial resonant cavity. A wide resonant frequency range of the coaxial resonant cavity is obtained due to the high resonant frequency of the coaxial resonant cavity. The resonant frequency of the coaxial resonant cavity continuously varies within the resonant frequency range by adjusting the height of the cavity body, thus, the resonant frequency of the coaxial resonant cavity can be rapidly adjusted within the resonant frequency range by varying the height of the cavity body. In addition, clutter in the output microwave signal can be avoided by controlling the height of the cavity body to be greater than the sum of the outer radius and the inner radius of annular column of the cavity body.

Furthermore, the coaxial resonant frequency includes the inner conductor and the outer conductor sleeved onto the inner conductor, the cavity body is formed between the outer wall of the inner conductor and the inner wall of the outer conductor; the inner conductor is shaped as the annular column having one end surface with a tip point which forms the probe. This facilitates the replacement of the inner conductor and the outer conductor such that the inner radius and the outer radius of the annular column can be varied.

Furthermore, the end inside the cavity adjacent to the probe is provided with the dielectric layer having a shape in conformity with the cavity body, and the dielectric layer is made of inorganic material with the dielectric constant being greater than 1. Since the dielectric layer is capable of reducing the resonant frequency of the coaxial resonant cavity, the resonant frequency range is further widened.

Furthermore, the dielectric layer is made of aluminum oxide, and the ratio of the thickness of the dielectric layer to the inner radius of the annular column is (1.5-2.5):1, which can ensure a relatively high quality factor as well as effectively reducing the resonant frequency.

Furthermore, the coupling mechanism includes at least one coupling ring, and the ratio of the radius of the coupling ring to the inner radius of the annular column is (0.5-1):1, which avoids clutter in the microwave signal and ensures a relatively high quality factor.

Compared with the prior art, the system for measuring the dielectric constant of a material and the measuring method with the above coaxial resonant cavity of the present disclosure have a fast measuring speed and a high measuring efficiency respectively.

Compared with the prior art, the microwave flaw detection device with the above coaxial resonant cavity of the present disclosure has a fast measuring speed and a high measuring accuracy.

Compared with the prior art, the filter with the above coaxial resonant cavity of the present disclosure has a wide frequency range.

Compared with the prior art, the microwave sterilization device with the above coaxial resonant cavity of the present disclosure has a good sterilization effect.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. A coaxial resonant cavity, comprising a coupling mechanism and a cavity body, the coupling mechanism being accommodated in the cavity body for exciting or coupling microwaves inside the cavity body, wherein the coaxial resonant cavity further comprises a probe extending out of the cavity body and being coaxial with the cavity body; the cavity body is shaped as an annular column, and a ratio of an outer radius of the annular column to an inner radius of the annular column is (3-5):1; a height of the cavity body is adjustable, the cavity length is adjusted within a range from 21 to 35 mm, a dielectric layer is formed on one end inside the cavity body adjacent to the probe, the dielectric layer is shaped in conformity with the cavity body, and the dielectric layer is made of inorganic material with the dielectric constant being greater than 1, and a ratio of a thickness of the dielectric layer to the inner radius of the annular column is (1.5-2.5):1.

2. The coaxial resonant cavity of claim 1, wherein a height of the cavity body is adjustable, and the height of the cavity body is greater than a sum of the outer radius and the inner radius of the annular column.

3. The coaxial resonant cavity of claim 1, wherein the coaxial resonant cavity comprises an inner conductor and an outer conductor coaxially sleeved onto the inner conductor; the cavity body is formed between an outer wall of the inner conductor and an inner wall of the outer conductor and the inner conductor is shaped as a cylinder having an end surface with a tip point forming the probe.

4. The coaxial resonant cavity of claim 1, wherein the coupling mechanism comprises at least one coupling ring, and a ratio of a radius of the coupling ring to the inner radius of the annular column is (0.5-1):1.

5. The coaxial resonant cavity of claim 1, wherein the coaxial resonant cavity is used in a system for measuring electromagnetics properties of a material.

6. The coaxial resonant cavity of claim 1, wherein the coaxial resonant cavity is used in a microwave flaw detection device.

7. The coaxial resonant cavity of claim 1, wherein the coaxial resonant cavity is used in a filter.

8. The coaxial resonant cavity of claim 1, wherein the coaxial resonant cavity is used in a microwave sterilization device.

9. A system for measuring the dielectric constant of a material, comprising a coaxial resonant cavity and a control system; wherein the coaxial resonant cavity comprises a cavity body and a probe extending out of the cavity body, the cavity body is shaped as an annular column, and a ratio of an outer radius of the annular column to an inner radius of the annular column is (3-5):1; a height of the cavity body is adjustable, the cavity length is adjusted within a range from 21 to 35 mm, a dielectric layer is formed on one end inside the cavity body adjacent to the probe, the dielectric layer is shaped in conformity with the cavity body, and the dielectric layer is made of inorganic material with the dielectric constant being greater than 1, a ratio of a thickness of the dielectric layer to the inner radius of the annular column is (1.5-2.5):1; the control system is configured for supplying a input microwave signal of the coaxial resonant cavity, the probe forms an electromagnetic field outside the cavity body, and a to-be-measured sample varies an output microwave signal of the coaxial resonant cavity through interfering with the electromagnetic field; the control system is further configured for analyzing the output microwave signal of the coaxial resonant cavity, and the control system calculates the dielectric constant of the to-be-measured sample by analyzing the output microwave signals of the coaxial resonant cavity before and after the placement of the to-be-measured sample.

10. The system of claim 9, further comprising a sample placement table for position the sample and an adjuster being capable of adjusting a position of the sample placement table and a position of the coaxial resonant cavity.

11. The system of claim 10, wherein the coaxial resonant cavity is controlled to move along an axial direction thereof, and the sample placement table is controlled to move across a surface perpendicular to the axial direction by the adjuster.

12. The system of claim 9, further comprising a database having a collection of data corresponding to a hollow state of the coaxial resonant cavity.

13. The system of claim 9, wherein a height of the cavity body is adjustable, and the height of the cavity body is greater than a sum of the outer radius and the inner radius of the annular column.

14. The system of claim 9, wherein the coaxial resonant cavity comprises a coupling mechanism connected to the control system, the coupling mechanism comprises at least one coupling ring, and a ratio of a radius of the coupling ring to the inner radius of the annular column is (0.5-1):1.

15. A measuring method for measuring the dielectric constant of a material, comprising the following steps: obtaining a resonant frequency and a quality factor when a coaxial resonant cavity is in a hollow state; placing a sample; performing a frequency sweep to obtain the resonant frequency and the quality factor of the coaxial resonant cavity after the placement of the sample; and calculating the dielectric constant of the sample according to the resonant frequencies and the quality factors of the coaxial resonant cavity before and after the placement of the sample; wherein the coaxial resonant cavity comprises a cavity body and a probe extending out of the cavity body, the cavity body is shaped as an annular column, and a ratio of an outer radius of the annular column to an inner radius of the annular column is (3-5):1; a height of the cavity body is adjustable, the cavity length is adjusted within a range from 21 to 35 mm, a dielectric layer is formed on one end inside the cavity body adjacent to the probe, the dielectric layer is shaped in conformity with the cavity body, and the dielectric layer is made of inorganic material with the dielectric constant being greater than 1, a ratio of a thickness of the dielectric layer to the inner radius of the annular column is (1.5-2.5):1.

16. The method of claim 15, wherein the resonant frequency and the quality factor of the coaxial resonant cavity when the coaxial resonant cavity is in a hollow state are obtained from a database, and establishing of the database comprises following steps: recording a cavity length and information of a dielectric layer; performing a frequency sweep to obtain the resonant frequency and the quality factor; recording the resonant frequency and the quality factor obtained through the frequency sweep, and building a correspondence between the resonant frequency and the quality factor and the recorded cavity length and information of the dielectric layer; adjusting the cavity length or replacing the dielectric layer; and repeating the above steps and storing corresponding data.

* * * * *